US007741002B2

(12) United States Patent
Uchinokura et al.

(10) Patent No.: US 7,741,002 B2
(45) Date of Patent: Jun. 22, 2010

(54) TONER, TONER PRODUCTION METHOD, AND IMAGE FORMING METHOD

(75) Inventors: Osamu Uchinokura, Mishima (JP); Fumihiro Sasaki, Fuji (JP); Satoshi Mochizuki, Numazu (JP); Hidetoshi Noda, Kyoto (JP); Tsuyoshi Fukushima, Kyoto (JP); Koutaro Kitano, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 728 days.

(21) Appl. No.: 11/558,736

(22) Filed: Nov. 10, 2006

(65) Prior Publication Data

US 2007/0134581 A1 Jun. 14, 2007

(30) Foreign Application Priority Data

Nov. 11, 2005 (JP) ..... 2005-328120

(51) Int. Cl.
*G03G 9/08* (2006.01)

(52) U.S. Cl. ..... 430/137.14

(58) Field of Classification Search ..... 430/137.17
See application file for complete search history.

(56) References Cited

U.S. PATENT DOCUMENTS 6,303,258 B1 10/2001 Katoh et al.
6,356,729 B1 3/2002 Sasaki et al.
6,360,068 B1 3/2002 Kinoshita et al.
6,416,914 B1 7/2002 Nakamura et al.
6,432,590 B1 8/2002 Ueda et al.
6,503,676 B2 1/2003 Yamashita et al.
6,733,939 B2 5/2004 Nanya et al.
6,757,507 B2 6/2004 Mochizuki et al.
6,770,411 B2 8/2004 Masuda et al.
6,818,369 B2 11/2004 Sugiura et al.
6,818,370 B2 11/2004 Uchinokura et al.
6,855,468 B1 2/2005 Yamamoto et al.
6,861,191 B2 3/2005 Mochizuki et al.

(Continued)

FOREIGN PATENT DOCUMENTS

JP 06-282105 10/1994

(Continued)

OTHER PUBLICATIONS

English translation of JP 2005-070680 published Mar. 2005.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

The present invention provides a method for producing a toner including preparing an emulsified dispersion which contains emulsion particles by emulsifying or dispersing an oil phase containing at least a pigment and any one of a binder resin and a binder resin precursor in an aqueous medium, and granulating toner base particles by converging the emulsified dispersion, wherein the Casson yield value of the single oil phase before being emulsified or dispersed in the aqueous medium is 0.5 Pa to 20 Pa; and the temperature Tn of the emulsified dispersion in the preparation of the emulsified dispersion, the temperature Ts of the emulsified dispersion in the granulation of the toner base particles, and the glass transition temperature Tg of the toner base particles satisfy the relation Tn<Ts<Tg.

12 Claims, 2 Drawing Sheets

U.S. PATENT DOCUMENTS

| | | | | |
|---|---|---|---|---|
| 6,902,857 | B2 | 6/2005 | Yagi et al. | |
| 6,902,858 | B2 | 6/2005 | Mochizuki et al. | |
| 6,946,229 | B2 | 9/2005 | Suzuki et al. | |
| 7,024,140 | B2 | 4/2006 | Masuda et al. | |
| 2001/0044059 | A1 | 11/2001 | Miyamoto et al. | |
| 2002/0098436 | A1 | 7/2002 | Miyamoto et al. | |
| 2003/0104297 | A1 * | 6/2003 | Matsuda et al. | 430/108.3 |
| 2003/0152857 | A1 | 8/2003 | Sugiura et al. | |
| 2003/0180643 | A1 | 9/2003 | Suzuki et al. | |
| 2003/0232266 | A1 | 12/2003 | Sugiura et al. | |
| 2004/0067189 | A1 | 4/2004 | Sugiura et al. | |
| 2004/0072091 | A1 | 4/2004 | Mochizuki et al. | |
| 2004/0076901 | A1 | 4/2004 | Miyamoto et al. | |
| 2004/0096767 | A1 * | 5/2004 | Tsuji et al. | 430/137.17 |
| 2004/0115550 | A1 | 6/2004 | Sugiura et al. | |
| 2004/0229143 | A1 | 11/2004 | Umemura et al. | |
| 2004/0253528 | A1 | 12/2004 | Yamashita et al. | |
| 2005/0003289 | A1 | 1/2005 | Fushimi et al. | |
| 2005/0026064 | A1 | 2/2005 | Sugiura et al. | |
| 2005/0089786 | A1 | 4/2005 | Sugiura et al. | |
| 2005/0089787 | A1 | 4/2005 | Uchinokura et al. | |
| 2005/0191575 | A1 | 9/2005 | Sugiura et al. | |
| 2005/0208408 | A1 | 9/2005 | Uchinokura et al. | |
| 2005/0255399 | A1 | 11/2005 | Ichikawa et al. | |
| 2006/0029433 | A1 | 2/2006 | Saito et al. | |
| 2006/0040194 | A1 | 2/2006 | Sugiura et al. | |
| 2006/0063081 | A1 | 3/2006 | Nagatomo et al. | |
| 2006/0093946 | A1 | 5/2006 | Miyamoto et al. | |
| 2006/0165989 | A1 | 7/2006 | Takikawa et al. | |
| 2006/0172215 | A1 | 8/2006 | Kotsugai et al. | |

FOREIGN PATENT DOCUMENTS

| | | |
|---|---|---|
| JP | 11-060739 | 3/1999 |
| JP | 2000-029240 | 1/2000 |
| JP | 3451522 | 7/2003 |
| JP | 2004-170820 | 6/2004 |
| JP | 3572829 | 7/2004 |
| JP | 3637464 | 1/2005 |
| JP | 2005-049858 | 2/2005 |
| JP | 2005-070680 | * 3/2005 |
| JP | 3661819 | 4/2005 |
| JP | 3671701 | 4/2005 |

OTHER PUBLICATIONS

U.S. Appl. No. 09/384,797, filed Aug. 27, 1999, Satoru Miyamoto.
U.S. Appl. No. 11/852,778, filed Sep. 10, 2007, Nagatomo et al.
U.S. Appl. No. 11/857,791, filed Sep. 19, 2007, Kojima et al.
U.S. Appl. No. 12/040,451, filed Feb. 29, 2008, Saitoh et al.
U.S. Appl. No. 12/050,502, filed Mar. 18, 2008, Yamada et al.
U.S. Appl. No. 12/203,278, filed Sep. 3, 2008, Yamada et al.

* cited by examiner

TONER, TONER PRODUCTION METHOD, AND IMAGE FORMING METHOD

BACKGROUND OF THE INVENTION

1. Field of the Invention

The present invention relates to a toner to be used for formation of images based on an electrostatic photographic process such as for copiers, facsimiles, and printers. The present invention also relates to a method for producing the toner and an image forming method using the toner.

2. Disclosure of the Related Art

An electrophotographic image forming method includes a transferring step for transferring an image onto the surface of an image transferring member, a fixing step for fixing a toner image on the surface of the image transferer, and a cleaning step for removing a residual toner remaining on the surface of the image bearing member after the transferring process, In recent years, forming of higher-quality images is increasingly required. In particular, to achieve formation of highly fine color images, researches aimed at making toner particles have smaller particle diameters and forming toner particles in a spherical shape have been under way. Making toner particles having smaller particle diameters allows improving dot-reproductivity, and forming toner particles in a spherical shape allows improving developing property and transferring property of toner. Since it is very difficult to produce a spherically shaped toner having smaller particle diameters by kneading and pulverizing method, polymerized toners produced by suspension polymerization method, emulsion polymerization method, or dispersion polymerization method are being employed.

However, when a spherically-shaped toner having small particle diameters is used, it raises the following problems during cleaning of a residual toner remaining on an image bearing member.

Conventionally, as a unit for removing a residual toner remaining on an image bearing member after a transferring process, blade cleaning system has been used because of its simple structure and excellence in removing ability of a residual toner. A cleaning blade system removes a toner while sliding on and rubbing the surface of an image bearing member, however, the edge portions of the cleaning blade are deformed due to frictional resistance to the image bearing member. Therefore, a microscopic clearance is induced between the cleaning blade and the image bearing member because the smaller toner particle diameter, the easier the toner particles enter the clearance. The nearer to a spherical shape the entered toner has, the smaller the rolling frictional force is. Thus, the entered toner particles start to roll in the clearance between the image bearing member and the cleaning blade and slip through the cleaning blade, thereby resulting in cleaning failures.

Then, a proposal is presented to address troubles concerning cleaning ability of a residual toner while improving the developing property and transferring property of a toner by controlling the shape of the toner such that the toner has a somewhat different shape from a spherical shape.

For example, Japanese Patent Application Laid-Open (JP-A) No. 11-060739 discloses a method in which in the process where a plurality of primary particles were associated with and fused to each other in a solution containing primary particles having thermal adhesiveness and at least one solvent to thereby produce secondary particles, the required agitation power per unit volume is varied according to the average toner particle diameter of particles. However, associating completely solid primary particles with each other, not associating oil droplets with each other, needs raising the temperature of the components to make the primary particles thermally fused to each other. Therefore, the method has problems with low-productivity and widening a particle size distribution.

Japanese patent Application Laid-Open (JP-A) No. 06-282105 discloses a method for producing toner particles for developing electrostatically charged images which includes adding inorganic oxide fine particles to a color resin dispersion in which resin fine particles containing at least a pigment are dispersed in an aqueous medium to flocculate color resin fine particles, heating the color resin dispersion to fusion-bond the flocculated color resin particles, thereby forming associated particles. However, the method needs raising the to temperature of the color resin dispersion to the glass transition temperature or more to associate primary particles with each other, and thus it is difficult to control the particle size distribution.

Japanese Patent Application Laid-Open (JP-A) No. 2005-049858 discloses a method for producing a toner containing toner resin particles which contain a resin (a) and a filler (b), in which toner resin particles have a volume average particle diameter of 3 μm to 10 μm, and a shape factor (SF-2) of 110 to 300; each of the toner resin particles has an outer shell layer (S) containing at least a part of the filler (b); and the outer shell layer (S) has a thickness of 0.01 μm or more and a half or less of the maximum inscribed circle radius of the cross-sectional surface of the particles. However, the toner production method has problems that the shape of toner cannot be sufficiently controlled, and toner particles may be formed in a spherical shape.

In addition, Japanese Patent Application Laid-Open (JP-A) No. 2005-070680 discloses an apparatus for producing a toner for electrophotographic image formation, which is provided with a continuous emulsifying apparatus and is used for a method in which a toner composition containing at least a resin, a colorant, and a releasing agent is dissolved or dispersed in an organic solvent and the solution or dispersion is continuously emulsified in an aqueous medium. The toner production apparatus is provided with a unit which allows varying the accumulation volume of emulsified portions In such a process for forming toner particles to have a somewhat different shape from a spherical shape, when particles after being subjected to an emulsification process are unevenly and indefinitely shaped, the level of how the shearing force is applied to the toner particles is uneven in the process of forming of toner particles to have a somewhat different shape from a spherical shape, Thus, the obtained toner particles differently shaped from spherically shaped toner particles are also unevenly formed. When the shape of toner particles differently shaped from spherically shaped toner particles is uneven, the cohesion force between toner particles is reduced in a fixing process. This adversely affects fixing of image to cause an increase in lower limit fixing temperature of the toner.

SUMMARY OF THE INVENTION

The present invention aims to provide a toner whose particle size distribution and shape can be controlled, and a method for producing the toner, and an image forming method using the toner.

The method for producing a toner of the present invention includes preparing an emulsified dispersion by emulsifying or dispersing an oil phase containing at least a pigment and any one of a binder resin and a binder resin precursor in an aqueous medium, and granulating toner base particles by converging the emulsified dispersion, wherein the Casson yield value of the oil phase in an isolated condition before being emulsified or dispersed in the aqueous medium is 0.5 Pa to 20 Pa; and the temperature of the emulsified dispersion Tn in the preparation of the emulsified dispersion, the temperature of the emulsified dispersion Ts in the granulation of the toner base particles, and the glass transition temperature Tg of the toner base particles satisfy the relation Tn<Ts<Tg.

The toner of the present invention can be produced by the method for producing a toner of the present invention.

The image forming method of the present invention includes at least forming a latent electrostatic image on a latent electrostatic image bearing member, developing the latent electrostatic image using a toner to form a visible image, transforming the visible image onto a recording medium, and fixing the transferred image on the recording medium, wherein the toner is the toner of the present invention.

Figure 1:
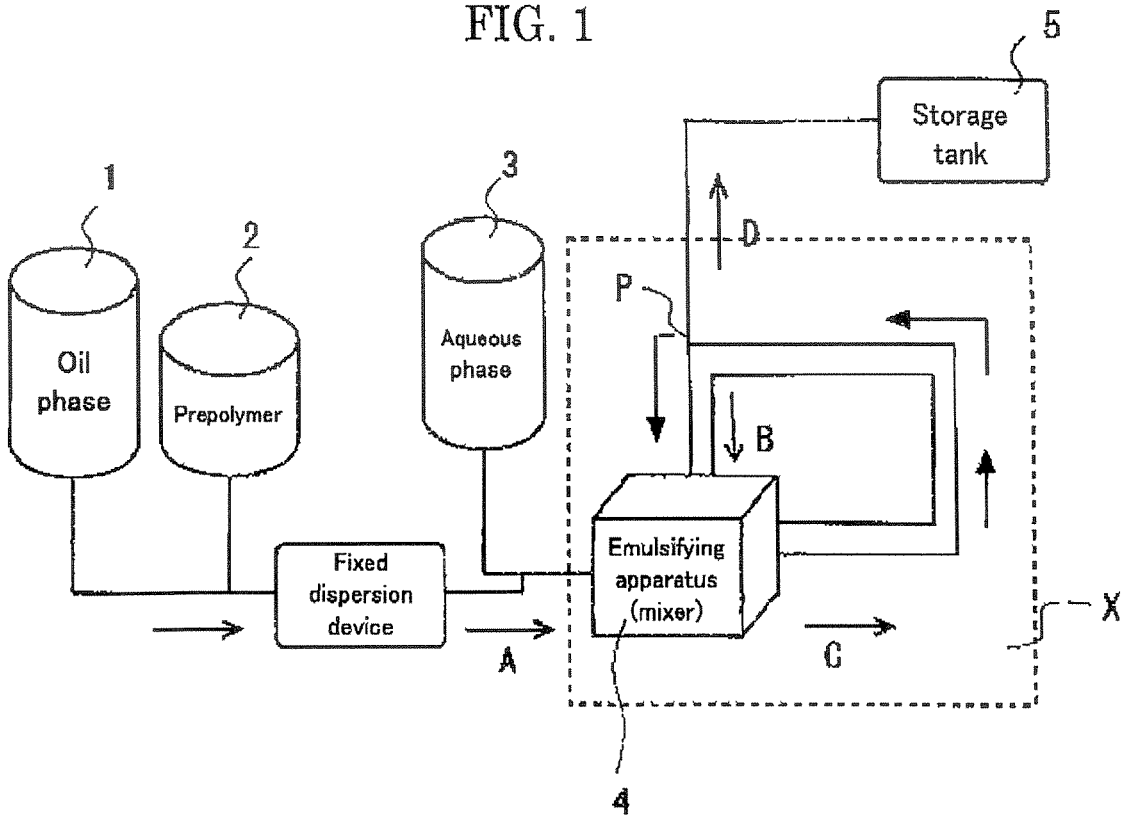
FIG. 1 is a schematic view exemplarily showing an example of a reaction apparatus used when emulsion particles of the present invention were produced.

DESCRIPTION OF THE PREFERRED EMBODIMENTS (Toner and Method for Producing the Toner)

The method for producing a toner of the present invention includes preparing an emulsified dispersion by emulsifying or dispersing an oil phase containing at least a pigment and any one of a binder resin and a binder resin precursor in an aqueous medium, and granulating toner base particles by converging the emulsified dispersion and further includes other steps in accordance with the necessity.

In the method for producing a toner, the Casson yield value of the oil phase in an isolated condition before being emulsified or dispersed in the aqueous medium is 0.5 Pa to 20 Pa; and the temperature Tn of the emulsified dispersion is the preparation of the emulsified dispersion, the temperature Ts of the emulsified dispersion in the granulation of the toner base particles, and the glass transition temperature Tg of the toner base particles satisfy the relation Tn<Ts<Tg.

The toner of the present invention can be produced by the method for producing a toner of the present invention.

The Casson yield value is defined as follows. The above-mentioned oil phase, in particular, the oil phase containing a pigment and a binder resin takes on a non-Newtonian flow which is also referred to as a nonlinear plastic flow. By making the oil phase take on a non-Newtonian flow, a shear stress is applied to the emulsion particles, thereby particles can be differently formed from spherically shaped particles. The rheologic property of the oil phase is represented by Casson's equation as follows.

$$\tau 0.5=\tau 0.05+\eta c0.5\cdot\gamma 0.5 \qquad \text{Equation 1}$$

($\tau$: shear stress (Pa), $\tau 0$: Casson yield value (Pa·s), $\gamma$: shear rate (s−1), and $\eta c$: Casson viscosity (Pa))

When the fluid liquid takes on a pseudo plastic fluid, the properties of the oil phase can be characterized by establishing a linear relation between $\tau 0.5$ and $\gamma 0.5$. The Casson viscosity means a viscosity measured when the shear rate of the fluid reaches an infinite value. Further, "$\tau 0$" is a Casson yield value and represents the minimum shear stress required to cause a flow. Thus, to induce a low in an oil phase, there is a need to apply a higher stress than the Casson yield value to the aqueous medium. Particularly when a stress is applied to an oil phase in an aqueous medium, a desired stress cannot be applied unless the Casson viscosity and the Casson yield value are controlled.

In the present invention, the Casson viscosity and the Casson yield value of the oil phase were determined as follows. The shear stress of the oil phase to be used in the present invention was successively measured at a temperature of 25° C. and a shear rate $\gamma$ ranging 0.105 to 2.10 using a rotation viscometer made in combination with an E-type rotation viscometer and a ST rotor (EMD-STE, available from TOKI SANGTYO CO., LTD.). The relation between the shear rate ($\gamma 0.5$) and the shear stress ($\tau 0.5$) was plotted to obtain a rheogram. The viscosity obtained from the gradient of the straight line drawn on the rheogram was taken as the Casson viscosity. The viscosity $\gamma 0$ in the case where the shear rate was zero was taken as the Casson yield value.

The Casson yield value of the oil phase in an isolated condition was 0.5 Pa to 20 Pa. As described above, the Casson yield value and the viscosity used for applying stresses to the oil phase can be adjusted depending on the type and the volume of a pigment in the oil phase, the molecular mass and the blending amount of a binder resin and/or a binder resin precursor, the type and the addition amount of the solvent, and the temperature of the oil phase. It is preferable to set a lower Casson yield value because the lower the Casson yield value is, the oil phase is applied with a smaller stress. However, when the Casson yield value is less than 0.5 Pa, the preparation of an oil phase including formulations of a pigment and the like to be contained in the toner is difficult, and toner particles cannot be differently formed from spherically shaped particles when a small shear stress is applied to the oil phase. When the Casson yield value is more than 20 Pa, a sufficient shear condition required for an oil phase is rarely obtained, which makes it impossible to form an appropriate particle size distribution and to stabilize the shape of particles.

It is conceivable that the shear stress caused by the aqueous medium has little influence on the Casson viscosity, however, an appropriate shear stress needs to be applied to the oil phase. Specifically, the Casson viscosity of the oil phase is typically 0.5 Pa·s to 20 Pa·s, and more preferably 5 Pa·s to 15.0 Pa·s.

Further, the viscosity of the oil phase is gradually varied after the oil phase is emulsified in the preparation of the emulsified dispersion. The viscosity variation of emulsified particles includes factors caused by a reaction and factors that are changed by a slightly amount of the aqueous medium dissolved in the oil phase in the emulsification process. Thus, it is difficult to accurately grasp the rheologic property of the oil phase after the oil phase has been emulsified. Specifically, variations in viscosity were observed when salt, for example, NaCl was added to the emulsified dispersion, the emulsified system lost a balance, and then the oil phase was taken out to measure the viscosity of the oil phase. The oil phase showed a different condition of viscosity from the viscosity of the oil phase in an isolated condition.

For the reason, in the present invention, the process of the granulation in which the emulsified dispersion is granulated into toner base particles is controlled by controlling the temperatures of the emulsified dispersion in the initial condition and the emulsified dispersion in the course of granulation process, i e. by means of temperature which is a modulator factor of the Casson yield value and Casson viscosity.

In the present invention, the temperature Tn of the emulsified dispersion in the preparation of the emulsified dispersion and the temperature Ts of the emulsified dispersion in the granulation of toner base particles need to satisfy the following Relational (1-1).

$$Tn<Ts \quad \text{Relation (1-1)}$$

When the temperature Tn and the temperature Ts satisfy the Relation (1-1), the reaction proceeds, in the process of granulating of toner base particles, the viscosity of the emulsified dispersion is increased, and the Casson yield value is also increased. When the temperature Tn is equal to or higher than the temperature Ts ($Tn \geqq Ts$), it is difficult to control the shape of particles without greatly increasing the viscosity of the oil phase, even when a same stress is applied to the emulsified dispersion in initial granulation of toner base particles. Then, in the present invention, the mobility of materials (such as inorganic fine particles, etc.) that affect particularly the Casson yield value in oil droplets can be increased by setting the temperature Ts of the emulsified dispersion in the process of granulating toner base particles higher than the temperature Tn of the emulsified dispersion in the process of preparing the emulsified dispersion. It is conceivable that due to this influence, thixotropy property can be easily exerted, and it is possible to easily make the emulsified dispersion tend to be non-Newtonia, the particle diameter of particles to be toner particles can be controlled, and the toner particles can be differently formed from spherically shaped toner particles in a controllable manner.

Further when the temperature Tn and the temperature Ts satisfy the Relation (1-1), the temperature Ts of the emulsified dispersion in the process of granulating toner base particles and the glass transition temperature Tg of the toner base particles satisfy the following Relation (1-2).

$$Ts<Tg \quad \text{Relation (1-2)}$$

When the temperature of Ts of the emulsified dispersion is higher than the glass transition temperature Tg, particles in the course of granulation make contact with each other and become connate to increase in size, and thus it is difficult to control the particle diameter of toner base particles. For the reason, by setting the temperature Ts of the emulsified dispersion lower than the glass transition temperature, it is possible to prevent the particles from coarsening due to particle cohesion and prevent gelation of the emulsified dispersion, and to allow differently forming particles from spherically shaped particles while keeping a narrow particle size distribution.

In the present invention, it is preferred that inorganic oxide fine particles be contained in materials of the toner. The viscosity of the oil phase varies depended on each of color pigments contained in the oil phase for preparing toner base particles. To make all the emulsified dispersions take on a non-Newtonian flow, it is necessary to reduce the difference in the Casson yield value and the viscosity caused by colorants such as pigments. For the reason, inorganic oxide fine particles are preferably contained in materials of the toner The inorganic oxide fine particles are preferably white so as not to impair pigment colors. Examples of the inorganic oxide fine particles include silicas, aluminas, titanium oxides, zinc oxides, tin oxides, cerium oxides, colcothar, antimony trioxides, magnesium oxides, and zirconium oxides. Examples of the silicas include indefinitely shaped silica, spherically shaped silica, and organosilica. Organosilica is particularly preferable. Organosilica can be obtained by dispersing silica in a solvent containing silica such as methylethylketone, methyl isobutyl ketone, cyclohexanone or a solvent which is hardly soluble in water, for example, ester such as ethylacetate, butylacetate, and methyl methacrylate. When organosilica exists inside or near the surface of an oil phase or an emulsified dispersion, not in an aqueous medium, a small amount of organosilica content allows making the emulsified dispersion take on a non-Newtonia flow. Thus, by containing inorganic oxide fine particles, particularly containing organosilica, the Casson yield value and the viscosity of the oil phase containing colorants and the like can be easily adjusted.

Further, in the present invention, the temperature Tn of the emulsified dispersion in the process of preparing the emulsified dispersion containing emulsion particles and the temperature Ts of the emulsified dispersion in the process of granulating toner base particles satisfy the following relation (2)

$$Tn+5^\circ\,C.<Ts<Tg-5^\circ\,C. \quad (2)$$

Setting the temperature Ts of the emulsified dispersion in the process of granulating toner base particles 5° C. higher than the temperature Tn of the emulsified dispersion in the process of preparing the emulsified dispersion containing emulsion particles allows further easy exertion of thixotropy property of the emulsified dispersion and allows making the emulsified dispersion take on a non-Newtonian flow. This also allows controlling of the particle diameter of particles to be toner base particles and controlling the i,s shape factor for differently forming particles from spherically shaped particles Further, setting the temperature Ts of the emulsified dispersion in the process of granulating toner base particles 5° C. or more lower than the glass transition temperature Tg of the toner base particles allows preventing the particles from coarsening due to particle cohesion and gelation of the emulsified dispersion, and allows differently forming particles from spherically shaped particles while keeping a narrow particle size distribution.

At this point in time, the glass transition temperature (Tg) of the toner base particles is preferably 40° C. to 55° C. When the glass transition temperature (Tg) of the toner base particles is set lower than 40° C., it is difficult to store the toner at room temperature for a long period of time, and hot offset phenomena may often occur in fixing process resulting in abnormal images. When the glass transition temperature (Tg) is set higher than 55° C., the heating temperature in fixing process needs to be raised because of the degraded fixing property, and thus the running cost of an image forming apparatus becomes higher. Further it is impossible to make the toner have high glossiness in fixing process, resulting in degradation in image quality.

With the above-noted configuration, in the present invention, the average circularity of toner base particles can be adjusted to 0.930 to 0.970.

The average circularity of toner base particles is a value obtained by optically detecting toner base particles, and dividing the projected area of a toner base particle by the circumferential length of a circle which has the same area as the projected area of the toner base particle. Specifically, the average circularity of toner base particles can be measured by using a flow particle image analyzer (FPIA-2000, available from SYSMEX Corp.). Specifically, to a given vessel, 100 mL to 150 mL of water with impurity solids previously removed therein is poured. Then, 0.1 mL to 0.5 mL of a surfactant is added as a dispersing agent to the vessel, and approximately 0.2 g to 9.5 g of a measured sample was added thereto The suspension with the sample dispersed therein is subjected to a dispersion treatment in a ultrasonic dispersion device for about 1 minute to 3 minutes to adjust the concentration of the dispersion to 2,000 pieces/μL to 10,000 pieces/μL, thereby measuring the shape and the distribution of toner base particles.

By adjusting the average circularity of toner base particles to 0.97 or less, a toner which excels in dot-reproductivity, developing property, and transferring property can be produced, and the toner shape which is advantageous in cleaning ability can be obtained. In the meanwhile, by making the toner base particles have an average circularity of 0.93 or more, i.e., by making the projected area shape of particles substantially close to a circle, a toner which is excellent in dot reproductivity and allows obtaining a high transferring rate can be produced When the average circularity is less than 0.93, the shape of toner base particles departs from a spherical shape, the dot reproductivity is degraded, and the number of contact points between an image bearing member and a photoconductor is increased. Thus, it will be a toner of which the releasing property and transferring rate are degraded.

The concentration of solid content of the oil phase is preferably adjusted to 40% by mass to 60% by mass. The oil phase contains at least a pigment and a binder resin and/or a binder resin precursor, however, it is preferable that the oil phase further contains inorganic oxide fine particles.

By adjusting the concentration of solid content of the oil phase within a certain definite range, the thixotropy property can be easily exerted, and the oil phase can be easily tend to take on a non-Newtonian flow. In addition, it allows controlling the particle diameter of particles to be toner base particles and controlling the shape factor for differently forming particles from spherically shaped particles. When the concentration of solid content of the oil phase is less than 40% by mass, the oil phase remains in a state of Newtonian flow, and thus a shear stress cannot be applied to the emulsified dispersion. When the concentration of solid content of the oil phase is more than 60% by mass, the Casson yield value and the viscosity are increased. Thus, a greater driving force is required for stirring, resulting in reduction in productivity.

In addition, the oil phase to be emulsified and/or dispersed in an aqueous medium contains a resin having functional groups capable of reacting with a compound having an active hydrogen group. By containing a resin having functional groups capable of reacting with a compound having an active hydrogen group in the oil phase, the oil phase is emulsified and/or dispersed in an aqueous medium to form emulsion particles, and then making a polymerization reaction proceed in the emulsion particles. The molecular mass of the resin having the functional group is increased by the polymerization, and the Casson yield value and the viscosity of the emulsion particles are increased, thereby the emulsion particles can easily tend to take on a non-Newtonian flow, and the particle diameter of particles to be toner base particles can be controlled and the shape factor can be controlled for differently forming particles from spherically shaped particles.

For example, as the resin having a functional group capable of reacting with a compound having an active hydrogen group, a modified polyester resin can be subjected to an elongation reaction and/or a crosslinking reaction.

Specific examples of materials to be used in the method for producing a toner of the present invention will be described below.

The composition used in the method for producing a toner contains a compound having an active hydrogen group, and binder resin components including a modified polyester resin capable of reacting with the compound having an active hydrogen group, and the composition may further contain toner components such as a colorant, a releasing agent, and a charge controlling agent. Hereinafter, materials contained in the composition to be used for the production of the toner will be described, <Modified Polyester Resin>

Examples of the modified polyester resin are polyester resins having a functional group capable of reacting with a compound having an active hydrogen group. Examples of the functional group include isocyanate groups, and epoxy groups.

In the present invention, for the modified polyester resin, a polyester prepolymer having an isocyanate group can be used. Example of the polyester prepolyiner having an isocyanate group (A) include products obtained by further reacting a polyester which is a polycondensate of a polyol (1) with a polycarboxylic acid (2) and has an active hydrogen group with a polyisocyanate (3). Examples of the active hydrogen group held by the polyester include hydroxyl groups (alcohol-hydroxyl groups and phenol-hydroxyl groups) amino groups, carboxylic groups, and mercapto groups. Of these, alcohol-hydroxyl groups are preferably used.

Examples of the polyol (1) include diols (1-1) and trivalent or more polyols (1-2). Single use of a diol (1-1) or a mixture of a diol (1-1) with a small amount of a trivalent or more polyol (1-2) is preferable.

Examples of the diol (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.);

cycloaliphatic diols (1,4-cyclohexanedimethanol, hydrogenated bisphenol A, etc.); bisphenols (bisphexiol A, bisphenol F, bisphenol S, etc); alkylene oxide adducts of the cycloaliphatic diols (ethylene oxide, propylene oxide, butylene oxide, etc.); and alkylene oxide adducts of the bisphenols (ethylene oxide, propylene oxide, butylene oxide, etc.). Of these, alkylene glycol having 2 to 12 carbon atoms and alkylene oxide adducts of bisphenols are preferable. Alkylene oxide adducts of bisphenols, and a combination of the alkylene oxide adduct with an alkylene glycol having 2 to 12 carbon atoms are particularly preferable.

Examples of the trivalent or more polyols (1-2) include trivalent to octavalent or more polyvalent aliphatic alcohols (glycerin, trimethylolethane, trimethylolpropane, pentaerythritol, sorbitol, etc.); trivalent or more phenols (trisphenol PA, phenol novolac, cresol novolac, etc.); and alkylene oxide adducts of the trivalent or more polyphenols.

Examples of the polyearboxylic acid (2) include dicarboxylic acids (2-1), and trivalent or more polycarboxylic acids (2-2). Of these, single use of a dicarboxylic acid (2-1) or a mixture of a dicarboxylic acid (2-1) with a small amount of a trivalent or more polycarboxylic acid (2-2) is preferable. Examples of the dicarboxylic acids (2-1) include alkylene dicarboxylic acids (succinic acid, adipic acid, and sebacic acid, etc.); alkenylene dicarboxylic acids (maleic acid, fumaric acid, etc.); aromatic dicarboxylic acids (plithalic acid, isophthalic acid, terephthalic acid, naphthalene dicarboxylic acid, etc.). Of these, alkenylene dicarboxylic acid having 4 to 20 carbon atoms and aromatic dicarboxylic acids having 8 to 20 carbon atoms are preferable.

Examples of the trivalent or more polycarboxylic acid (2-2) include aromatic polycarboxylic acids having 9 to 20 carbon atoms (trimellitic acid, pyromellitic acid, etc.). For the polycarboxylic acid (2), acid anhydrides of the above noted polycarboxylic acids may be used, or polyol (1) may be reacted with lower alkyl esters such as methyl ester, ethyl ester, and isopropyl ester for use.

To prepare a polyester having an alcohol hydroxyl group at the terminal end of the molecule by a polycondensation reaction, the mixture ratio between the polyol (1) and the polycarboxylic acid (2) represented as the equivalent ratio [OH]/[COOH] of hydroxy group [OH] content in the polyol (1) to carboxyl group [COOH] content in the polycarboxylic acid (2) is preferably 2/1 to 1/1, more preferably 1.5/1 to 1/1, and still more preferably 1.3/1 to 1.02/1.

Examples of the polyisocyanate (3), which is reacted with an alcohol-hydroxyl group of the above-noted polyesters to thereby prepare a polyester prepolymer, include aliphatic polyisocyanates (tetramethylen diisocyanate, hexamethylene dilsocyanate, and 2,6-diisocyanato methyl caproate, etc.); alicyclic polyisocyanates (isophorone diisocyanate, and cyclohexyl methane diisocyanate, etch); aromatic diisocyanates (tolylene diusocyanate, and diphenylmethane diisocyanate, etc.); aromatic aliphatic dilsocyanates (α, α, α', α'-tetramethyl xylylene diisocyanate, etc.); isocyanurates; polyisocyanates in which any one of the above-noted isocyanates is blocked with a phenol derivative, an oxime, a caprolactam, or the like; or a combination of two or more selected from the above-noted ones.

The mixture ratio of the polyisocyanate, as represented by the equivalent ratio [NCO]/[OH], i.e. isocyanate group [NCO] in the polyisocyanate to hydroxy group [OH] in the hydroxy-containing polyester is typically 5/1 to 1/1, preferably 4/1 to 1.2/1, and more preferably 2.5/1 to 1.5/1. When the ratio [NCO]/[OH] is more than 5, low-temperature fixing property degrades, and when the molar ratio of [NCO] is less than 1, elongation and/or crosslinking reaction with an active hydrogen group-containing compound, which will be described hereafter, cannot be performed due to too small amount of isocyanate group contained in the polyester prepolymer (A).

The number of isocyanate groups per molecule contained in the isocyanate group-containing polyester prepolymer (A) is preferably one or more, more preferably 1.5 to 3 on an average, and more preferably 1.8 to 2.5 on an average. When the number of isocyanate groups per molecule contained in the isocyanate group-containing polyester prepolymer (A) is less than one, the molecular mass of the modified polyester resin after the elongation and/or crosslinking reaction is reduced, and sufficient anti-hot offset property cannot be obtained for toner, and the like.

<Unreactive Polyester>

In the present invention, it is important to contain not only the polyester prepolymer (A) but also an unmodified unreactive polyester (C) as binder resin components in materials of the toner. A combination with the unmodified unreactive polyester (C) allows for improving low-temperature fixing property, and glossiness of the toner when used in a full-color image forming apparatus.

Examples of unmodified unreactive polyester (C) include a polycondensate of a polyol (1) having the same components as those of the polyester components of the polyester prepolymer (A) with a polycarboxylic acid (2). Preferred examples are also the same as those of the polyester prepolymer (A).

For the unmodified unreactive polyester (C), not only unmodified polyesters but also those modified by chemical bonds other than urea groups may be used, for example, it may be modified by urethane groups.

It is preferred that at least part of the polyester prepolymer (A) is soluble to the unmodified unreactive polyester (C), from the perspective of anti-hot offset property. Thus, it is preferred that the polyester components of the polyester prepolymer (A) have a similar composition to that of the unmodified unreactive polyester (C).

When containing the unmodified unreactive polyester (C), the mass ratio of (A) to (C) is preferably 5/95 to 75/25, more preferably 10/90 to 25/75, still more preferably 12/88 to 25/75, and particularly preferably 12/88 to 22/78. When the mass ratio of the polyester prepolymer (A) is less than 5%, anti-hot offset property of the toner and the like may be degraded, and it may bring disadvantages in obtaining satisfactory heat resistance storage stability and low-temperature fixing property.

The peak molecular mass of the unmodified unreactive polyester (C) measured by Gel Permeation Chromatography (GPC) is preferably 1,000 to 30,000, more preferably 1,500 to 10,000, and still more preferably 2,000 to 8,000. When the peak molecular mass is less than 1,000, heat resistance storage stability of the toner and the like may degrade, and when the peak molecular mass is more than 10,000, low-temperature fixing property may degrade.

The hydroxy group value of the unmodified unreactive polyester (C) is preferably 5 mgKOH/g or more, more preferably 10 mgKOH/g to 120 mgKOH/g, and still more preferably 20 mgKOH/g to 80 mgKOH/g. When the hydroxy group value of the unmodified unreactive polyester (C) is less than 5 mgKOH/g, it is disadvantageous in obtaining satisfactory heat resistance storage stability and low-temperature fixing property.

The acid value of the unmodified unreactive polyester (C) is typically 0.5 mgKOH/g to 40 mgKOH/g, and preferably 5 mgKOH/g to 35 mgKOH/g. Unmodified unreactive polyester having an acid value exceeding the defined range is easily susceptible to high-temperature and high-humidity environments and low-temperature and low-humidity environments and easily causes degradation of images.

The acid value represents the total amount of acid components residing at the terminal end of the molecule, and the measuring method of acid value is in accordance with the JIS K0070. However, when a test sample cannot be dissolved, dioxane, THF, or the like is used as a solvent <Active Hydrogen Group Containing Compound>

As will hereinafter be described, a modified polyester resin having a higher molecular mass than that of the isocyanate group containing polyester prepolymer (A) is generated by subjecting the polyester prepolymer (A) to an elongation and/or crosslinking reaction with the active hydrogen containing compound.

For the active hydrogen group containing compound, amines can be used. Examples of the amines (B) include diamines (B1), trivalent or more polyamines (B2), aminoalcohols (B3), amino mercaptans (B4), amino acids (B5), and compounds (B6) in which any of the amino groups B1 to B5 is blocked.

Examples of the diamine (B1) include aromatic diamines such as phenylene diamine, diethyl toluene diamine, and 4,4'-diamino-diphenyl methane; alicyclic diamines such as 4,4'-diamino-3,3'-dimethyl dicyclohexyl methane, diamine cyclohexane, and isophorone diamine, and aliphatic diamines such as ethylene diamine, tetramethylene diamine, and hexamethylene diamine.

Examples of the trivalent or more polyamines (B2) include diethylene triamine, and triethylene tetramine.

Examples of the aminoalcohols (B3) include ethanol amine, and hydroxyethylaniline.

Examples of the amino mercaptans (B4) include aminoethyl mercaptan, and aminopropyl mercaptan.

Examples of the amino acids (B5) include aminopropionic acids, aminocaproic acids.

Examples of the compounds (B6) in which any one of the amino groups B1 to B5 is blocked include ketimine compounds which are obtained from any of the above-noted amines B1 to B6 and ketones such as acetones, methyl ethyl ketones, and methyl isobutyl ketones, and oxazolidone compounds.

Of these amines (B), (B1) alone and mixtures of (B1) and a small amount of (B2) are preferable.

The mixture ratio of the amines (B) to the isocyanate-group containing polyester prepolymer (A),as represented as the equivalent ratio [NCO]/[NHx], i.e. the isocyanate group [NCO] in the isocyanate-group containing polyester prepolymer (A) to the amino group [NHx] in the amines (B) is typically 1/2 to 2/1, preferably 1.5/1 to 1/1.5, and more preferably 1.2/1 to 1/1.2, When the equivalent ratio [NCO]/[NHx] is more than 2 or less than 1/2, the molecular mass of the urea-modified polyester resin may be reduced, resulting in degraded anti-hot offset property.

Further, in the elongation and/or crosslinking reaction, a stopper can be used to adjust the molecular mass of the modified polyester resin after the reaction in accordance with the necessity. Examples of the stopper include monoamines such as diethylamine, dibutylamine, butylamine, laurylamine; or compounds in which any one of the monoamines is blocked such as ketimine compounds.

<Colorant>

The colorant is not particularly limited, and all the dyes and pigments known in the art can be used. Examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BQL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, PRLL, F4RH), fast scarlet VD, vulcan fast robin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indantlirene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and mixtures thereof Each of these colorants may be used alone or in combination with two or more.

The content of colorants in the toner is typically 1% by mass to 15% by mass, and preferably 3% by mass to 10% by mass.

The colorants used in the present invention may be used as a complex masterbatch compound with resins. Example of binder resins kneaded in the course of production of the masterbatch or kneaded together with the masterbatch include, besides the urea modified polyester resins (A) and the reactive polyester resins (C), styrenes such as styrene polystyrenes, poly-p-chlorostyrenes, and polyvinyl toluenes or polymers of derivative substitution thereof; styrene copolymers such as styrene-p-chlorostyrene copolymers, styrene-propylene copolymers, styrene-vinyltoluene copolymers, styrene-vinyl nahthalene copolymers, styrene-methyl acrylate copolymers, styrene-ethyl acrylate copolymers, etyrene-butyl acrylate copolymers, styrene-octyl acrylate copolymers, styrene-methyl methacrylate copolymers, styrene-ethyl methacrylate copolymers, styrene-butyl miethacrylate copolymers, styrene-α-methyl chloromethacrylate copolymer, styrene-acrylonitrile copolymers, styrene-vinylmethyl-keton copolymers, styrene-butadiene cop olymers, styrene-isoprene copolymers, styrene-acrylonitrile-indene copolymers, styrene-maleic acid copolymers, and styrene-ester maleate copolymers; polymethyl methaerylates, polybutyl methacrylates, polyvinyl chlorides, polyvinyl acetates, polyethylenes polypropylenes, polyesters, epoxy resins, epoxy polyol resins, polyurethanes, polyamides, polyvinyl butyrals, polyacrylic resins, rosins, modified rosins, terpene resins, aliphatic or alicyclic hydrocarbon resins, aromatic petroleum resins, chlorinated paraffins, and paraffin waxes. Each of these binder resins may be used alone or in combination with two or more.

The masterbatch may be produced by applying a high shearing force to the resins for the masterbatch and the colorants and mixing or kneading the components. To improve the interaction between the colorants and the resins, an organic solvent may be added thereto. Besides, a so-called flashing process is preferably employed, because in the flashing process, a wet cake of colorants can be directly used without the necessity of drying In the flashing process, a colorant-water-paste containing water is mixed and kneaded with resins and an organic solvent to transfer the colorants to the resins and then to remove the moisture and the organic solvent components For the mixing and kneading, a high shearing dispersion unit such as a triple roll mill is preferably used.

The colorants or masterbatch can be dissolved or dispersed in the organic solvent phase, but it is not limited thereto.

<Releasing Agent>

To the toner of the present invention, waxes may be included together with the toner binder and the colorants. Waxes known in the art may be used in the toner, and examples thereof include polyolefin waxes such as polyethylene waxes, and polypropylene waxes; long-chain hydrocarbons such as paraffin waxes, and sazol waxes; and carbonyl group-containing waxes. Of these, carbonyl group-containing waxes are preferably used. Examples of the carbonyl group-containing waxes include polyalkanoic acid esters such as carnauba waxes, montan waxes, trimethylolpropane tribehenate, pentaerythritol tetrabehenate, pentaerythritol diacetate dibehenate, glycerin behenate, and 1,18-octadecandiol distearate; polyalkanol esters such as tristearyl trimellitate, and distearyl maleate; polyalkanoicamides such as ethylene diamine dibehenylamides; polyalkylamides such as tristearylamide trimellitate; and dialkylketones such as distearylketone. Of these carbonyl group-containing waxes, polyalkanoic acid esters are preferably used.

The melting point of the wax is preferably 40° C. to 160° C., more preferably 50° C. to 120° C., and still more preferably 60° C. to 90° C. A wax having a melting point less than 40° C. is liable to negatively affect heat resistance storage stability, and a wax having a melting point more than 160° C. is liable to cause cold offset in fixing at low temperatures.

The melting viscosity of the wax is preferably 5 cps to 1,000 cps as a measurement value at a temperature 20° C. higher than the melting point, and more preferably 10 cps to 100 cps. A wax having a melting viscosity more than 1,000 cps is ineffective in enhancing the effects of anti-hot-offset property and low temperature fixing property.

The content of the wax in the toner is typically 0% by mass to 40% by mass, and preferably 3% by mass to 30% by mass. The wax can be dissolved or dispersed in the organic solvent phase, but it is not limited thereto.

<Charge Controlling Agent>

In the toner of the present invention, a charge controlling agent can be included in accordance with the necessity. For the charge controlling agent, those known in the art can be used, and examples thereof include nigrosine dyes, triphenylmaethane dyes, chrome-containing metallic complex dyes, molybdic acid chelate pigments, rhodamine dyes, alkoxy amines, quaternary ammonium salts (including fluorine-modified quaternary ammonium salts); alkylamides, phosphoric simple substance or compounds thereof, tungsten simple substance or compounds thereof, fluorine activator, salicylic acid metallic salts, and salicylic acid derivative metallic salts. Specifically, examples of the controlling agents include Bontron 03 being a nigrosine dye, Bontron P-51 being a quaternary ammonium salt, Bontron S-34 being a metal-containing azo dyes, Bontron E-82 being an oxynaphthoic acid metal complex, Bontron E-84 being a salicylic acid metal complex, and Bontron E-89 being a phenol condensate (available from Orient Chemical Industries, Ltd.); TP-302 and TP-415 being a quaternary ammonium salt molybdenum metal complex (available from Hodogaya Chemical Co.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (available from Hoechst Corporation); LRA-901, and LR-147 being a boron metal complex (available from Japan Carlit Co., Ltd.); copper phthalocyanine, perylene, quinacridone, azo pigments, and other high-molecular mass compounds having a functional group such as sulfonic acid group, carboxyl group, and quaternary ammonium salt.

The amount of the charge controlling agent used in the present invention is determined depending on the type of the binder resin, presence or absence of additives used in accordance with the necessity, the actual developing conditions including the dispersion process, and the fixing conditions and is not limited uniformly, however, relative to 100 parts by mass of the binder resin, the charge controlling agent is preferably used in the range from 0.1 parts by mass to 10 parts by mass, and more preferably in the range from 0.2 parts by mass to 5 parts by mass. When the usage amount of the charge controlling agent is more than 10 parts by mass, charge property of the toner is exceedingly large, which may reduce the effect of the primarily used charge controlling agent, and electrostatic suction force to developing rollers increases, resulting in lessened flowability of the developer and reduced image density. The charge controlling agent may be dissolved and dispersed in the toner material after kneading the masterbatch and resins. The charge controlling agent may also be directly added to the organic solvent at the time of dissolving and dispersing the toner material. In addition, the charge controlling agent may be added and fixed to surfaces of toner particles after producing the toner particles.

[Organic Solvent]

The organic solvent is not particularly limited as long as it allows dissolving or dispersing the toner composition. Preferred ones are volatile organic solvents having a boiling point of 150° C. or less, in terms of easy removal of the solvent. Examples thereof include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, and tetrahydrofuran Each of these organic solvents may be used alone or in combination with two or more. Of these, methyl acetate, and ethyl acetate are particularly preferable in that they are easily volatile after toner base particles are formed.

The usage amount of the organic solvent relative to 100 parts by mass of the solid components of the toner base particles is preferably 40 parts by mass to 300 parts by mass, more preferably 60 parts by mass to 140 parts by mass, and still more preferably 80 parts by mass to 120 parts by mass.

[Aqueous Medium]

For the aqueous medium, water may be used singularly, or a water-miscible solvent may also be used concurrently with water. Examples of the water-miscible solvent include alcohols such as methanol, isopropanol, and ethylene glycol; dimethylformamide, tetrahydrofuran, Cellosolves; and lower ketones such as acetone, and methyl ethyl ketone. Each of these water-miscible solvents may be used alone or in combination with two or more.

In the present invention, a toner composition containing at least the polyester prepolymer (A) and amines (B) is dissolved or dispersed in an organic solvent, and the obtained dissolved solution or dispersed solution is emulsified and dispersed in an aqueous medium, thereby the polyester prepolymer (A) and the amines (B) are subjected to an elongation and/or crosslinking reaction. In the elongation and/or crosslinking reaction, a nitrogen-containing compound is added to the organic solvent.

The nitrogen-containing compound is contained in the toner composition of the organic solvent and serves to adjust the acid value of the toner composition within the appropriate range.

In the production process of the toner of the present invention, when the amount of the acid components in the toner composition is excessively large, the crosslinking and/or elongation reaction between the polyester prepolymer (A) and the amines (B) hardly proceeds due to presence of the unreactive polyester (C). Even when the unreactive polyester (C) has an acid value of 0.5 mgKOH/g to 40 mgKOH/g, by mixing a nitrogen-containing compound with the toner composition to form the unreactive polyester (C) and a salt, the influence of the acid components contained in the toner composition can be eliminated to make the crosslinking and/or elongation reaction proceed. With this, the emulsification and convergence conditions of the toner composition can be stabilized, thereby the uniformity of emulsion particles in the aqueous medium can be improved.

Beside the components stated above, as a resin having a reactive functional group, the following ones can be added. Specific examples of the resin having a reactive functional group include styrene monomers such as o-methyl styrene, m-methyl styrene, p-methoxy styrene, p-ethyl styrene, p-tertiary butyl styrene, acrylic acid esters such as acrylic acid, methyl acrylate, ethyl acrylate n-butyl acrylate, n-propyl acrylate, isobutyl acrylate, octyl acrylate, dodecyl acrylate, 2-ethylhexyl acrylate, stearyl acrylate, 2-chlorethyl acrylate, and phenyl acrylate; methacrylic acid esters such as methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylamino methyl methacrylate, and benzyl methacrylate; 2-hydroxyethyl acrylate, 2-hydroxyethyl methacrylate, acrylonitrile, methacrylonitrile, and acrylamide; alkyl vinyl ethers such as methyl vinyl ether, ethyl vinyl ether, propyl vinyl ether, n-butyl ether, and isobutyl ether; diene compounds such as β-chlorethyl vinyl ether, phenyl vinyl ether, p-methyl phenyl ether, p-chlorphenyl ether, p-bromphenyl ether, p-nitrophenyl vinyl ether, p-methoxyphenyl vinyl ether, and butadiene; acrylic acid, methacrylic acid, crotonic acid, itaconic acid, maleic acid, fumaric acid, monobutyl itaconate, monobutyl maleate, and phosphoric acid-containingmonomers, for example, acid phosphooxyethyl methacrylate, acid phosphooxypropyl methacrylate, sulfone acid group-containing monomers, dimethylamino ethyl acrylate, diethylamino ethyl methacrylate, acroylmorfolin, 2-vinyl pyridine, 3-vinyl pyridine, 4-vinyl pyridine, N-vinyl pyrolidone, 20 vinyl imidazole, N-methyl-2-vinyl imidazole, and N-vinyl imidazole. Each of these monomers may be used alone or in combination with two or more, and a combination which allows obtaining preferable properties can be selected.

Examples of the active hydrogen group containing compound include azobis compounds such as 2,2'-azobis-(2,4-dimethyl valeronitrile), 2,2'-azobisisobutylonitril, 1,1'-azobis-(cyclohexane-1-carbonitrile), 2,2'-azobis-4-methoxy 2,4-dimethyl valeronitrile or diazo compounds thereof, amidine compounds such as 2,2'-azobis (2-aminodipropane) dihydrochloride, 2,2'-azobis(N,N'-dimethylene isobutylamidine), 2,2'-azobis (N,N'-dimethylene isobutylamidine) dihydrochloride; and peroxides such as benzoyl peroxide, methyl ethyl ketone peroxide, diisopropyl peroxy carbonate, cumene hydroperoxide, and lauryl peroxide. Each of these active hydrogen group-containing compounds may be used alone or in combination with two or more.

Hereinafter, a preferred example of processes of the method for producing a toner of the present invention will be described, however, the processes of the method for producing a toner of the present invention are not limited to the following example, (1) A colorant, an unmodified polyester, a polyester prepolymer having an isocyanate group, and a releasing agent are dispersed in an organic solvent. Further inorganic oxide fine particles (such as organosilica) are added thereto. The components are mixed to prepare a material solution for toner base particles. It is preferable that an organic solvent used here has a boiling point less than 100° C. and is volatile in terms that the organic solvent can be easily removed after formation of toner base particles. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone can be used singularly, or a combination with two or more selected from the above can be used. Particularly, aromatic solvents such as toluene and xylene; and halogenated hydrocarbons such as methylene chloride, 1,2-dichloroethane, chloroform, and carbon tetrachloride are preferably used.

The usage amount of the organic solvent is preferably zero parts by mass to 300 parts by mass relative to 100 parts by mass of the polyester prepolymer, more preferably zero parts by mass to 100 parts by mass, and still further preferably 25 parts by mass to 70 parts by mass.

(2) A material solution for toner base particles is prepared in the presence of inorganic oxide fine particles, and an emulsified dispersion is prepared in an aqueous medium.

For the aqueous medium, water may be used singularly, or the aqueous medium may contain an organic solvent containing alcohol (methanol, isopropyl alcohol, and ethylene glycol, etc.), dimethyl formamide, tetrahydrofuran, Cellosolves (methyl Cellosolve, etc.), and/or lower ketones (acetone, methyl ethyl ketone, etc.).

The usage amount of the aqueous medium is preferably 50 parts by mass to 2,000 parts by mass relative to 100 parts by mass of the material solution for toner base particles, and more preferably 100 parts by mass to 1,000 parts by mass When the usage amount of the aqueous medium is less than 50 parts by mass, a toner having a predefined particle diameter may not be obtained due to the poor dispersion condition of the material solution for toner base particles When the usage amount is more than 2,000 parts by mass, it is costly.

To improve the dispersion condition of the aqueous medium, a dispersing agent such as a surfactant and inorganic fine particles may be added in an appropriate amount.

Examples of the surfactant include anionic surfactants such as alkylbenzene sulfonate, α-olefin sulfonate, and phosphate ester; amine salt cationic surfactants such as alkyl amine salt, amino alcohol fatty acid derivatives, polyamine fatty acid derivatives, and imidazoline; quaternary ammonium salt cationic surfactants such as alkyl trimethyl ammonium salt, dialkyl dimethyl ammonium salts, alkyl dimethyl benzyl ammonium salt, pyridinium salt, alkyl isoquinolium chloride, and benzethonium chloride; nonionic surfactants such as fatty acid amide derivatives, and polyvalent alcohol derivatives, for example, alanine, dodecyldi(aminoethyl) glycine, di(octylaminoethyl) glycine; and amphoteric surfactants such as N-alkyl-N,N-dimethyl ammonium betaine.

The use a small amount of a surfactant having a fluoroalkyl group can improve the dispersion condition of the aqueous medium. Examples of an anionic surfactant having a fluoroalkyl group include fluoroalkyl carboxylic acids having 2 to 10 carbon atoms and the metal salts thereof, perfluorooctane sulfonyl disodium glutamate, 3-[ω-fluoroalkyl ($C_6$ to $C_{11}$) oxy]-1-alkyl ($C_3$ to $C_4$), 3-[ω-fluoroalkanoyl ($C_6$ to $C_8$)-N-ethylamino]-1-propane sodium sulfonate, fluoroalkyl ($C_{11}$ to $C_{20}$) carboxylic acid or the metal salts thereof, perfluoroalkyl carboxylic acids ($C_7$ to $C_{13}$) or the metal salts thereof, perfluoroalkyl ($C_4$ to $C_{12}$) sulfonic acid or the metal salts thereof, perfluorooctane sulfonic acid dimethanol amides, N-propyl-N-(2-hydroxyethyl) perfluorooctane sulfonamide, perfluoroalkyl ($C_6$ to $C_{10}$) sulfonamide propyltrimethyl ammonium salt, perfluoroalkyl ($C_6$ to $C_{10}$)-N-ethyl sulfonyl glycine salt, and monoperfluoroalkyl ($C_6$ to $C_{16}$) ethyl phosphate esters.

Examples of the commercially available products thereof include Surflon S-111, S-112 and S-113 (available from Asahi Glass Co.); Prorard FC-93, FC-95, FC-98 and FC-129 (available from Sumitomo 3M Ltd.); Unidyne DS-101 and DS-102 (available from Daikin Industries, Ltd,); Megafac F-110, F-120, F-113, F-191, F-812 and F-833 (available from Dainippon Ink and Chemicals, Inc.); ECTOP EF-102, 103, 104, 105, 112, 123A, 123B, 306A, 501, 201 and 204 (available from Toohchem Products Co.); Futargent F-100 and F150 (available from Neos Co.).

Examples of the cationic surfactants include primary, secondary or secondary aliphatic amines having a fluoroalkyl group, aliphatic quaternary ammonium salts such as perfluoroalkyl ($C_6$ to $C_{10}$)sulfoneamide propyltrimethylammonium salt, beenzalkonium salt, benzetonium chloride, pyridinium salt, and imidazolinium salt Specific examples of the commercially available products thereof are Surflon S-121 (available from Asahi Glass Co.), Frorard PC-135 (available from Sumitomo 3M Ltd.), Unidyne DS-202 (available from Daikin Industries, Ltd,), Megaface F-150 and F-824 (available from Dainippon Ink and Chemicals, Inc.), Ectop EF-132 (available from Tohchem Products Co.), and Futargent F-300 (available from Neos Co.).

For the inorganic fine particles, silica and titania can be used as organosol. Besides, an inorganic compound dispersant such as hydroxy apatite can be used. Beside the inorganic fine particles, for resin fine particles, any resins can be used as long as the resin can form an aqueous dispersion, and the resin may be a thermoplastic resin or a thermosetting resin. Examples of the resin include vinyl resins, polyurethane resins, epoxy resins, polyester resins, polyamide resins, polyimide resins, silicon resins, phenol resins, melamine resins, urea resins, aniline resins, ionomer resins, and polyearbonate resins. Each of these resins may be used alone or in combination with two or more.

Of these, from the perspective that an aqueous dispersant of spherically-shaped microscopic resin particles can be easily obtained, vinyl resins, polyurethane resins, epoxy resins, polyester resins or a combination thereof are preferable. Examples of the vinyl resin include polymers of which a vinyl monomer is polymerized or copolymerized, for example, resins such as styrene-(meth)acrylic acid ester copolymer, styrene-butadiene copolymer, (meth)acrylic acid-acrylic ester polymer, styrene-acrylonitrile copolymer, styrene-maleic acid anhydride copolymer, and styrene-(meth)acrylic acid copolymer.

The average particle diameter of the resin fine particles is preferably 5 nm to 300 nm, and more preferably 20 nm to 200 nm.

For the resin fine particles, as a dispersing agent usable in combination with the inorganic compound dispersing agent, polymeric protective colloids may be used to stabilize the dispersed droplets. Examples of the polymeric protective colloids include acids such as acrylic acids, methacrylic acids, α-cyanoacrylic acids, α-cyanomethacrylic acids, itaconic acids, crotonic acids, fumaric acids, maleic acids, and maleic anhydrides; (meth)acryl monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl acrylate, 3-chloro-2-hydroxypropyl acrylate, 3-chloro-2-hydroxypropyl methacrylate, diethyleneglycol monoacrylate, diethyleneglycol monomethacrylate, glycerin imonoacrylate, glycerin inonomethacrylate, N-methylol acrylamido, and N-methylol methacrylamide; vinyl alcohols or esters with vinyl alcohols such as vinyl methyl ethers, vinyl ethyl ethers, and vinyl propyl ethers; or esters of vinyl alcohol and a compound having a carboxyl group such as vinyl acetates, vinyl propionates, and vinyl butyrates; amide compounds or methylol compounds thereof such as acryl amides, methacryl amides, diacetone acrylic amide acids, or methylols thereof; chlorides such as acrylic chlorides, and methacrylic chloride; honopolymers or copolymers having a nitrogen atom or heterocyclic ring thereof such as vinyl pyridines, vinyl pyrrolidone, vinyl imidazole, and ethylene imine; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, and polyoxyethylene nonylphenyl ester, and celluloses such as methyl cellulose, hydroxyethyl cellulose, and hydroxypropyl cellulose.

The dispersion method is not particularly limited, and may be suitably selected in accordance with the intended use. For example, devices known in the art such as low-speed shearing machine, high-speed shearing machine, frictional type shearing machine, high-pressure jet shearing machine, and supersonic shearing machine can be suitably used. Of these, a high-speed shearing machine is preferably used for making the particle diameter of the dispersant have a particle diameter of 2 μm to 20 μm. When a high-speed shearing machine is used, the rotation speed is not particularly limited, may be suitably selected in accordance with the intended use, however, it is preferably 1,000 rpm to 30,000 rpm, and 5,000 rpm to 20,000 rpm. The dispersion time is not particularly limited and may be suitably selected in accordance with the necessity, however, when a batch method is employed, it is preferably 0.1 minutes to 5 minutes. The dispersion temperature is preferably 0° C. to 150° C. (under pressure), and more preferably 40° C. to 98° C.

In the process of preparing an emulsified dispersion, it is preferred to prepare an emulsified dispersion using a continuous emulsifying unit.

Here, an embodiment of the method for producing a toner of the present invention will be described referring to drawings, FIG. 1 is a schematic view showing one example of a reactor used for carrying out the process of producing emulsion particles of the present invention. In FIG. 1, the raw material solution to be supplied from an oil phase 1 and a prepolymer tank 2 is passed through a fixed dispersing unit and then flows together with an aqueous solution containing inorganic fine particles supplied from an aqueous phase 3. The raw material solution and the aqueous lo solution are stirred and mixed in an emulsifying unit 4 to thereby be an emulsified solution. In the method for producing emulsion particles of the present invention, in an emulsified system X, supplying (A) of a raw material solution in an arbitrarily amount and discharging (D) of emulsified dispersion in the same amount as the supply quantity are carried out. The emulsified solution in the emulsifying unit 4 flows out in the direction C and passes through either a channel (D) or a channel (B) at the point of P, thereby being supplied to a storage tank 6 or being restored to the emulsifying unit 4 to circulate. By using a continuous emulsifying unit, the reaction can be performed continuously.

Emulsified particles are produced using the reactor by means of automatic control, and a toner can be more continuously produced by providing with measuring the particle diameter of emulsion particles, calculating the value representing the transitory condition of the measured particle diameter obtained in the measurement step, and controlling the stirring condition of the emulsifying unit based on the calculated value obtained in the calculation step.

(3) Concurrently with the preparation of the emulsified solution, amines (B) are added to the emulsified solution to react with the isocyanate group-containing polyester prepolymer (A).

The reaction involves crosslinking and/or elongation of molecular chains. The reaction time is selected depending on the reactivity between the isocyanate group structure of the polyester prepolymer (A) and amines (B), however, it is preferably 10 minutes to 40 hours, and more preferably 2 hours to 24 hours. The is reaction temperature is preferably 0° C. to 150° C., and more preferably 40° C. to 98° C. In addition, a catalyst known in the art can be added in accordance with the necessity. Examples of the catalyst include dibutyltin laurate, and dioctyltin laurate.

Here, the granulation of toner base particles may be performed in the storage tank 5. As shown in FIG. 1, continuously produced emulsion particles are stored in the storage tank 5, and in the storage tank 5, crosslinking and/or elongation reaction proceeds as a polymerization reaction of the resin having a reactive functional group with the modified polyester while adjusting the molecular mass of the resin having a reactive functional group. By taking the above steps, a toner can be produced continuously.

(4) After completion of the reaction, the organic solvent is removed from the emulsified dispersion (reaction product), and the reaction product is washed and dried to thereby yield toner base particles.

To remove the organic solvent, the temperature of the entire system is gradually increased with stirring in a laminar flow condition, a strong agitation is applied to the system within a certain range of temperatures before removal of the organic solvent. Then, fusiform-shaped toner base particles can be produced. By applying a strong agitation to the entire system in the step of removing the organic solvent, and the shape of toner base particles can be controlled so as to have a shape between a spherical shape and a rugby ball, and the surface of the toner base particles can be morphologically controlled within ranges from smooth surface to shriveled surface.

When a dispersion stabilizer which is soluble in acid and alkali such as calcium phosphate salt is used, the calcium phosphate salt can be removed from toner base particles by dissolving the calcium phosphate salt in an acid such as hydrochloride and washing the toner base particles. The calcium phosphate salt can also be removed by means of other treatments such as dissolution using enzyme.

The obtained toner base particles are subjected to a classification treatment in accordance with the necessity to control the particle size distribution to be a desired one, thereby toner particles having the desired toner size distribution can be yielded. In the classification treatment, fine particles can be removed from the toner base particles in a fluid by using a cyclone separator, a decanter separator, or a centrifugal separator After a drying treatment of toner base particles, the powdery toner base particles can also be subjected to a classification treatment, however, from the viewpoint of efficiency, it is preferred that the classification treatment be performed in a fluid. The obtained unnecessary fine particles or coarse particles can be restored to a kneading step to be used in forming of particles. The fine particles or coarse particles may be in a wet condition. It is preferred that the used dispersing agent be removed from the emulsified dispersion as much as possible and the removal of the dispersing agent is performed concurrently with the classification treatment.

In addition, a dry process of external additives can be provided to the obtained toner particles in accordance with the necessity to yield a toner. The dry process of external additives can be performed by a known method using a mixer, or the like. It is possible to mix the dried toner base particles with various types particles such as releasing agent fine particles, charge controlling agent fine particles, fluidizer fine particles, and colorants fine particles or to immobilize and fuse the toner base particles by giving a mechanical impact force to the mixture to thereby prevent removal of the different types of particles from surfaces of the complex particles. The toner particles can be mixed with a magnetic carrier, thereby obtaining a toner serving as a two-component developer.

Specifically, there are methods of applying a mechanical impact to the toner base particles, for example, a method in which an impact is applied by rotating a blade at high speed, and a method in which an impact is applied by introducing the mixed particles into a high-speed flow and accelerating the speed of the flow so as to make the particles impact with each other or so as to make the composite particles impact upon an impact board.

Specific examples of units employed in such a method are an angmill (available from Hosokawa micron Corp.), a modified I-type mill (available from Nippon Pneumatic Manufacturing Co., Ltd.) to decrease crushing air pressure, a hybridization system (available from Nara machinery Co., Ltd.), a krypton system (available from Kawasaki Heavy Industries, Ltd.), and an automatic mortar.

As the external additives for assisting the flowability, developing property, and charge property of toner, inorganic fine particles can be preferably used. The primary particle diameter of the inorganic fine particles is preferably 5 nm to 2 μm, and more preferably 5 nm to 500 nm. The specific surface area of the toner measured by the BET method is preferably 20 $m^2/g$ to 500 $m^2/g$. The usage amount of the inorganic fine particles is preferably 0.01% by mass to 5% by mass of the total amount of the toner, and more preferably 0.01% by mass to 2.0% by mass.

Examples of the inorganic fine particles include silica, alumina, titanium oxide, barium titanate, magnesium titanate, calcium titanate, strontium titanate, zinc oxide, tin oxide, silica sand, silica sand, clay, raica, wallastonite, silious earth, chromium oxide, cerium oxide, colcothar, antimony trioxide, magnesium oxide, zirconium oxide, barium sulfate, barium carbonate, calcium carbonate, silicon carbide, and silicon nitride.

Besides the above-mentioned, polymer particles, for example, polymer particles made from a polystyrene copolymer, a methacrylic acid ester copolymer, and an acrylic acid ester copolymer obtained by soap-free emulsion polymerization, suspension polymerization, or dispersion polymerization; and polycondensation polymers such as silicone, benzoguanamine, and nylon, and polymer particles obtained from a thermosetting resin. These fluidizers enable preventing degradation of toner's fluidity and charge properties even under high-humidity environment by providing a surface treatment thereto to improve hydrophobic properties. Preferred examples of finishing agents include silaite coupling agents, sililation reagents, silane coupling agents having a fluorinated alkyl group, organic titanate coupling agents, organic titanate coupling agents, aluminum coupling agents, silicon oils, and modified silicon oils.

When the toner is used as a two-component developer, the toner may be mixed with a magnetic carrier for use. For the content ratio of the toner to the carrier in a developer, the content of the toner is preferably 1 part by mass to 10 parts by mass relative to 100 parts by mass of carrier, and more preferably 3 parts by mass to 9 parts by mass relative to 100 parts by mass of carrier.

For the magnetic carrier, conventionally known powder such as iron powder, ferrite powder, magnetite powder, carrier coated with a magnetic resin, each having a particle diameter of around 20 μm to 200 μm can be used.

As the covering material, it is also possible to use polyvinyl resin and polyvinylidene resin such as acrylic resin, polymethyl methacrylate resin, polyacrylonitrile resin, polyvinyl acetate resin, polyvinyl alcohol resin, and polyvinyl butyral resin; polystyrene resins such as polystyrene resin, and styrene-acryl copolymer resin; halogenated olefin resins such as polyvinyl chloride; polyester resins such as polyethylene terephthalate resin, and polybutylene terephthalate resin; polyearbonate resins, polyethylene resins, polyvinyl fluoride resins, polyvinylidene fluoride resins, polytrifluoro ethylene resins, polyhexafluoro propylene resins, copolymers of vinylidene fluoride and acryl monomer, copolymers of vinylidene fluoride and vinyl fluoride; fluorotarpolyrners such as tarpolymer of tetrafluoro ethylene and viniylidene fluoride and non-fluoride monomer; and silicon resins.

In addition, a conductive powder may be included in the covering resin material in accordance with the necessity. As for the conductive powder, metal powder, carbon black, titanium oxide, tin oxide, zinc oxide or the like can be used. The conductive powder preferably has an average particle diameter of 1 μm or less. When the average particle diameter is greater than 1 μm, it is difficult to control the electrical resistance.

The toner of the present invention can also be used as a magnetic one-component toner using no carrier therein or as a nonmagnetic toner.

(Image Forming Method and Image Forming Apparatus)

The image forming method of the present invention includes at least latent electrostatic image forming, developing, transferring, and fixing and further includes other steps which are suitably selected in accordance with the necessity, for example, charge elimination, cleaning, recycling, and controlling.

The image forming apparatus of the present invention is provided with at least a latent electrostatic image bearing member, a latent electrostatic image forming unit, a developing unit, a transferring unit, and a fixing unit and is further provided with other units which are suitably selected in accordance with the necessity, for example, a charge elimination unit, a cleaning unit, a recycling unit, and a controlling unit.

The latent electrostatic image forming is a step in which a latent electrostatic image is formed on an image bearing member.

The latent image bearing member (may be referred to as "electrophotographic photoconductor" or "photoconductor") is not particularly limited as to the material, shape, structure, size, or the like, and may be suitably selected from among those known in the art. With respect to the shape, drum-shaped one is preferably used. Preferred examples of the material used for the latent image bearing member include inorganic photoconductors made from amorphous silicon, selenium, or the like, and organic photoconductors made from polysilane, phthalopolymethine, or the like. Among these materials, amorphous silicone or the like are preferably used in terms of longer operating life.

The latent electrostatic image can be formed, for example, by charging the surface of the latent electrostatic image bearing member uniformly and then exposing the surface thereof imagewisely by means of the latent electrostatic image forming unit.

The latent electrostatic image forming unit includes, for example, at least a charger configured to uniformly charge the surface of the image bearing member, and an exposer configured to expose the surface of the image bearing member imagewisely.

The surface of the latent electrostatic image bearing member can be charged by applying a voltage to the surface of the image bearing member through the use of, for example, the charger.

The charger is not particularly limited, may be suitably selected in accordance with the intended use, and examples thereof include contact chargers known in the art, for example, which are equipped with a conductive or semi-coinductive roller, brush, film, rubber blade or the like, and non-contact chargers utilizing corona discharge such as corotoron and scorotoron.

The surface of the latent electrostatic image bearing member can be exposed by exposing the surface of the image bearing member imagewisely through the use of, for example, the exposer.

The exposer is not particularly limited and may be suitably selected in accordance with the intended use, provided that the surface of the image bearing member which has been charged by the charger can be exposed imagewisely. Examples thereof include various types of exposers such as reproducing optical systems, rod lens array systems, laser optical systems, and liquid crystal shutter optical systems.

In the present invention, the back light method may be employed in which exposing is performed imagewisely from the back side of the image bearing member.

—Developing and Developing Unit—

The developing is a step in which the latent electrostatic image is developed using the toner or the developer of the present invention to form a visible image.

The visible image can be formed by developing the latent electrostatic image using, for example, the developer by means of the developing unit.

The developing unit is not particularly limited and may be suitably selected from those known in the art as long as a latent electrostatic image can be developed using the toner or the developer of the present invention. Preferred examples thereof include the one having at least an image developing apparatus which houses the toner or the developer therein and enables supplying the toner or the developer to the latent electrostatic image in contact or in non-contact. An image developing apparatus provided with the developer container of the present invention is more preferable.

The image developing apparatus may employ a dry-developing process or a wet-developing process. It way be an image developing apparatus for monochrome color or multi-colors. Preferred examples thereof include the one having a stirrer by which the developer is frictionally stirred to be charged, and a rotatable magnet roller.

In the image developing apparatus, for example, the toner and the carrier are mixed and stirred, the toner is charged by frictional force at that time to be held in a state where the toner is standing on the surface of the rotating magnet roller to thereby form a magnetic brush. Since the magnet roller is arranged near the latent electrostatic image bearing member, a part of the toner constituting the magnetic brush formed on the surface of the magnet roller moves to the surface of the latent electrostatic image bearing member (photoconductor) by electric attraction force. As a result, the latent electrostatic image is developed using the toner to form a visible toner image on the surface of the latent electrostatic image bearing member (photo conductor).

The developer to be housed in the image developing apparatus is a developer containing the toner of the present invention, —Transferring and Transferring Unit—

In the transferring, the visible image is transferred onto a recording medium, and it is preferably an aspect in which an intermediate transfer member is used, the visible image is primarily transferred to the intermediate transfer member and then the visible image is secondarily transferred onto the recording medium. An aspect of the transferring is more preferable in which two or more color toners are used, still more preferably a full-color toner is used, and the aspect includes a primary transferring in which the visible image is transferred to an intermediate transfer member to form a composite transfer image, and a secondary transferring in which the composite transfer image is transferred onto a recording medium.

The transferring can be performed, for example, by charging a visible image formed on the surface of the image bearing member (photoconductor) using a transfer-charger to transfer the visible image, and the visible image can be transferred by means of the transferring unit. For the transferring unit, it is preferably an aspect which includes a primary transferring unit configured to transfer the visible image to an intermediate transfer member to form to a composite transfer image, and a secondary transferring unit configured to transfer the composite transfer image onto a recording medium.

The intermediate transfer member is not particularly limited, may be suitably selected from among those known in the art in accordance with the intended use, and preferred examples thereof include transferring belts.

The transferring unit (the primary transferring unit and the secondary transferring unit) preferably includes at least an image-transferer configured to exfoliate the visible image formed on the latent electrostatic image bearing member to be charged and transfer the visible image onto the recording medium. For the transferring unit, one transferring unit or two or more transferring units may be used.

Examples of the image transferer include corona image transferers using corona discharge, transferring belts, transfer rollers, pressure transfer rollers, and adhesion image transfer units.

The recording medium is not particularly limited and may be suitably selected from among those known in the art.

—Fixing and Fixing Unit—

The fixing is a step in which a visible image which has been transferred onto a recording medium is fixed using a fixing apparatus, and the image fixing may be performed every time each color toner is transferred onto the recording medium or at a time so that each of individual color toners are superimposed at the same time.

The fixing apparatus is not particularly limited, may be suitably selected in accordance with the intended use, and heat-pressurizing units known in the art are preferably used. Examples of the heat-pressurizing units include a combination of a heat roller and a pressurizing roller, and a combination of a heat roller, a pressurizing roller, and an endless belt.

The fixing apparatus is preferably a unit which is provided with a heater equipped with a heat generator, a film making contact with the heater, and a pressurizing member making pressure-contact with the heater through the film and is configured to heat and fix a recording medium with an unfixed image formed thereon between the film and the pressurizing member.

The heating temperature in the heat-pressurizing unit is preferably 80° C. to 200° C.

In the present invention, for example, an optical fixing apparatus known in the art may be used along with or instead of the fixing step and the fixing unit.

—Charge Elimination and Charge Elimination Unit—

The charge elimination is a step in which the charge is eliminated by applying a charge-eliminating bias to the image bearing member, and it can be suitably performed by means of a charge-eliminating unit.

The charge-eliminating unit is not particularly limited and may be suitably selected from among charge-eliminating units known in the art as long as a charge-eliminating bias can be applied to the latent electrostatic image bearing member. For example, a charge-eliminating lamp or the like is preferably used.

—Cleaning and Cleaning Unit—

The cleaning is a step in which a residual electrographic toner remaining on the latent electrostatic image bearing member is removed, and the cleaning can be preferably performed using a cleaning unit.

The cleaning unit is not particularly limited and may be suitably selected from among those known in the art, provided that the residual electrophotographic toner remaining on the image bearing member can be removed. Examples of the cleaning unit include magnetic brush cleaners, electrostatic brush cleaners, magnetic roller cleaners, blade cleaners, brush cleaners, and web cleaners.

The recycling is a step in which the electrophotographic color toner that had been eliminated in the cleaning is recycled in the developing, and the recycling can be suitably performed by means of a recycling unit.

The recycling unit is not particularly limited, and examples thereof include carrying units known in the art.

The controlling is a step in which the above-noted individual steps are controlled, and the controlling can be suitably performed by means of a controlling unit.

The controlling unit is not particularly limited as long as it can control operations of the individual units, and may be suitably selected in accordance with the intended use. Examples thereof include equipment such as sequencers and computers.

Hereinafter, an image forming apparatus in which the toner of the present invention is used as a developer will be described.

Figure 2:
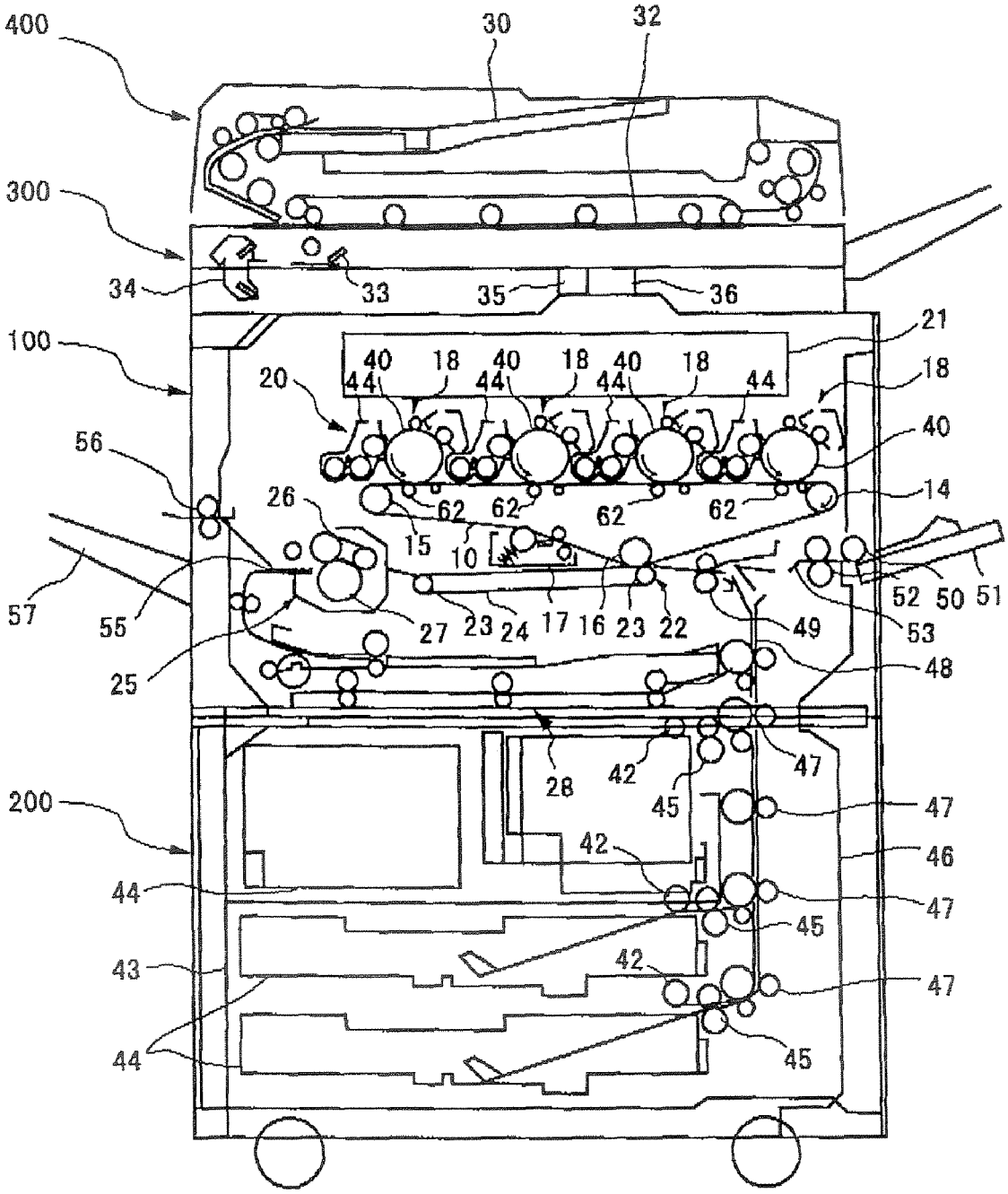
FIG. 2 is a schematic view exemplarily showing an example of an image forming apparatus used in the present invention

FIG. 2 is a schematic view exemplarily showing an example of an image forming apparatus used in the present invention. The image forming apparatus is provided with a copier main body 100, a sheet-feeder table 200, a scanner 300 which is mounted on the copier main body 100, and an automatic document feeder (ADF) 400 mounted on the scanner 300.

The copier main body 100 comprises a tandem-image-forming apparatus 20 having image-forming units 18 in which individual units for performing electrophotographic processes, such as, a charging unit, a developing unit, and a cleaner, are included and arranged in four parallel lines around photoconductor 40 as a latent electrostatic image carrier. On the upper side of the tandem-image-forming apparatus 20, exposing unit 21 configured to expose the photoconductor 40 based on image information by a laser beam to form a latent image is mounted. Intermediate transferring belt 10 made from an endless belt member is arranged such that the intermediate transferring belt 10 faces each photoconductor 40 in the tandem-image forming apparatus 20. At the positions opposed to each photoconductor 40 through the intermediate transferring belt 10, primary-transferring units 62 configured to transfer a toner image formed in each color on the photoconductor 40 onto the intermediate transferring belt 10 is located.

Beneath the intermediate transfer belt 10, a secondary transferer 22 is located which is configured to transfer the toner image superimposed on the intermediate transfer belt 10 to a transferring paper transported from the sheet-feeder table 200 in block. The secondary transferer 22 is configured to have a secondary transferring belt 24 being an endless belt which is spanned over a pair of rollers 23 and is located to be pressed against a supporting roller 16 through the intermediate transfer belt 10 to transfer the toner image on the intermediate transfer belt 10 onto a transferring paper.

An image fixing apparatus 25 configured to fix the image on the transferring paper is located beside the secondary transferee 22. The image fixing apparatus 25 is configured such that a pressure roller 27 is pressed against the fixing belt 26 being an endless belt.

The above-noted secondary transferee 22 also comprises a sheet-transportation function in which a transferring paper with an image transferred thereon is transported to the image fixing apparatus 25. Of course, a transferring roller and a noncontact charger may be located in the secondary transferer 22. In such a case, it is difficult to provide with the sheet-transportation function.

In the example as shown in the figure, a sheet reverser 28 that flips a sheet upside down in order to record images on both sides of the sheet is located below the secondary transferer 22 and the image fixing apparatus 25 and is also located in parallel to the tandem image forming device 20.

In an image developing apparatus 44 serving as a member of the image forming unit 18, a developer containing the above-noted toner is used. In the image developing apparatus 4, a developer-carrier carries and transports a developer to the position where the image developing apparatus 4 faces the photoconductor 40 and applies an alternating electric field to the photoconductor 40 then to develop a latent image on the photoconductor 40. Applying an alternating electric field enables activating a developer and narrowing down distribution of toner charge volume and to improve developing properties.

The developing apparatus 44 may be a process cartridge formed integrally with a photoconductor 40 in a single unit detachably mounted to the main body of the image-forming apparatus. The process cartridge may further include a charging unit, and a cleaning unit.

Operations of the image forming apparatus are as follows. Initially, a document is placed on a document platen 30 of the automatic document feeder (ADF) 400. Alternatively, the automatic document feeder (ADF) 400 is opened, a document is placed on contact glass 32 of the scanner 300, and the automatic document feeder (ADF) 400 is closed to press the document.

When pushing a start switch (not shown), the document placed on the automatic document feeder 400 is transported onto the contact glass 32, and the scanner 300 is immediately driven to operate a first carriage 33 and a second carriage 34. When the document is initially placed on the contact glass 32, by pushing the start switch (not shown), the scanner 300 is immediately driven to operate the first carriage 33 and the second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the document information.

By pressing the start switch (not shown), a drive motor (not shown) rotationally drives one of the supporting rollers 14, 15, and 16, and indirectly rotates two other supporting rollers so that the intermediate transferring belt 10 is rotationally moved. At the same time, at each image-forming units 18, its photoconductor 40 rotates, and monochrome images of black, yellow, magenta, and cyan are formed on each photoconductor 40. Then, as the intermediate transferring belt 10 moves, these monochrome images are successively transferred to form a composite color image on the intermediate transferring belt 10.

Also, by pressing the start switch (not shown), one of sheet-feeder rollers 42 of the sheet feeder table 200 is selected and driven so as to advance a sheet from one of sheet-feeder cassettes 44 that are stacked in multi-step vertically in a paper bank 43. The sheet is singly separated from other sheets by a separating roller 45 and advanced to a sheet-feeder path 46. Then, carrying roller 47 carries the sheet to guide the sheet to a sheet feeder path 48 in the copier main body 100 where the sheet hits a resist roller 49 and is stopped.

Alternatively, sheet-feeder roller 50 is rotated to advance a sheet from a manual bypass tray 51. Then, a separating roller 52 separates the sheet singly from other sheets and introduces the sheet to a manual-bypass-sheet-feeder path 53 where the sheet hits a resist roller 49 and is stopped.

Then, the resist roller 49 rotates in time with the composite color image on the intermediate transferring belt 10 and advances the sheet between the intermediate transferring belt 10 and the secondary transferer 22 where the secondary transferer 22 transfers the composite color image onto the sheet to record the color image.

After the image transfer, the secondary transferer 22 carries the sheet to the image fixing apparatus 25 where the image fixing apparatus 25 applies heat and pressure to fix the transferred image. Thereafter, a switching flap 55 switches so that the sheet is ejected by an ejecting roller 56 and stacked on a paper output tray 57. Alternatively, the sheet changes its direction by action of switch blade 55 into sheet reverser 28, turns therein, and is transported again to the transfer position, followed by image formation on the backside of the sheet. The sheet bearing images on both sides thereof is ejected through the ejecting roller 56 and then stacked onto the output tray 57.

After image transfer, the intermediate-transferring-belt cleaner 17 removes residual toner remaining on the intermediate transferring belt 10 so that the intermediate transferring belt 10 is ready for the next image forming by the tandem-image-forming apparatus 20.

Since the toner of the present invention allows uniformly controlling the size and shape of particles after being subjected to emulsification and convergence treatment by means of the unite used to solve the conventional problems, the particles after being differently forming toner particles from spherically shaped toner particles can be uniformly formed, and a toner which has high flocculation and excels in low-temperature fixing property can be obtained.

EXAMPLES

Hereafter, the present invention will be further described in detail referring to specific Examples and Comparative Examples, however, the present invention is not limited to the disclosed Examples.

It should be noted that in the examples below, "part" or "parts" means "part by mass" or "parts by mass", and "%" means "% by mass".

Hereinafter, the method for producing a toner of the present invention will be described in detail —Synthesis of Organic Fine Particle Emulsion—

To a reaction vessel equipped with a stirrer and a thermometer, 683 parts of water, 11 parts of sodium salt of the sulfuric acid ester of methacrylic acid ethylene oxide adduct (ELEMINOL RS-30, available from Sanyo Chemical Industries, Ltd.), 139 parts of styrene, 138 parts of methacrylic acid, 110 parts of butyl acrylate, 12 parts of butyl thioglycolate and 1 part of ammonium persuiphate were poured, and the components were stirred at 400 rpm for 15 minutes to obtain a white emulsion. The white emulsion was heated, the system temperature was raised to 75° C. and the reaction was performed for 5 hours. Next, 30 parts of an aqueous solution of 1% ammonium persulphate was added thereto, and the reaction mixture was aged at 75° C. for 5 hours to obtain an aqueous dispersion of a Vinyl resin (copolymer of styrene-methacrylic acid-butyl acrylate-sodium salt of the sulfuric acid ester of methacrylic acid ethylene oxide adduct). This aqueous dispersion was taken as particulate dispersion 1. The volume average particle diameter of the particulate dispersion 1 measured by a laser diffraction particle size distribution analyzer (LA-9201 available from Shimadzu Corporation) was 120 nm. A part of the particulate dispersion 1 was dried, and the resin therein was isolated. The glass transition temperature (Tg) of the resin was 42° C. and the mass average molecular mass of the resin was 30,000.

<Preparation of Aqueous Phase>

To 990 parts of water, 30 parts of the particulate dispersion 1, 37 parts of an aqueous solution of 48.5% sodium dodecyl diphenylether disulfonic acid (ELEMINOL MON-7, available from Sanyo Chemical Industries, Ltd.) and 90 parts of ethyl acetate were mixed and stirred to obtain a milky liquid. This was taken as aqueous phase 1.

<Synthesis of Unreactive Resin>

In a reaction vessel equipped with a condenser tube, a stirrer, and a nitrogen inlet tube, 218 parts of bisphenol A ethylene oxide dimolar adduct, 537 parts of bispihenol A propylene oxide trimolar adduct, 213 parts of terephthalic acid, 47 parts of adipic acid and 2 parts of dibutyl tin oxide were poured and the reaction was performed under normal pressure at 230° C. for 5 hours, and the reaction was further performed under a reduced pressure of 10mmHg to 15 mmHg for 5 hours, then 44 parts of anhydrous trimellitic acid were poured into the reaction vessel, and the reaction was performed at 180° C. under normal pressure for 2 hours to thereby obtain a polyester of an unreactive resin [A]. The unreactive resin [A] had a number average molecular mass of 2,500, a mass average molecular mass of 6,700, a glass transition temperature (Tg) of 44° C., and an acid value of 24 mgKOH/g.

<Synthesis of Intermediate Polyester>

In a reaction vessel equipped with a condenser tube, a stirrer, and a nitrogen inlet tube, 682 parts of bisplhenol A ethylene oxide dimolar adduct, 81 parts of bisphenol A propylene oxide dimolar adduct, 283 parts of terephthalic acid, 22 parts of trimellitic anhydride and 2 parts of dibutyl tin oxide were placed, and the reaction was performed under normal pressure at 230° C. for 8 hours, and then the reaction was further performed under a reduced pressure of 10 mmHg to 15 mmHg for 5 hours to obtain a polyester This polyester was taken as intermediate polyester 1. The obtained intermediate polyester 1 had a number average molecular mass of 2,100, a mass average molecular mass of 9,500, a glass transition temperature (Tg) of 55° C., an acid value of 0.5 mgKOH/g and a hydroxyl value of 51 mgKOH/g.

—Synthesis of Modified Polyester Resin Capable of Reacting with a Compound Having at Least an Active Hydrogen Group (Hereinafter, Referred to as Prepolymer 1)—

In a reaction vessel equipped with a condenser tube, a stirrer, and a nitrogen inlet tube, 410 parts of the intermediate polyester 1, 89 parts of isophorondiisocyanate, and 500 parts of ethyl acetate were poured, and the reaction was performed at 100° C. for 5 hours to obtain prepolymer 1. The percent by mass of free isocyanate of the prepolymer 1 was 1.53% by mass.

<Synthesis of Ketimine>

Into a reaction vessel equipped with a stirrer and a thermometer, 170 parts of isophorone diamine and 75 parts of methyl ethyl ketone were poured, and the reaction was performed at 50° C. for 5 hours to obtain a ketimine compound. This was taken as ketimine compound 1 The amine value of the ketimine compound 1 was 418.

<Preparation of Masterbatch 1>

In HENSCHEL MIXER (available from MITSUI MINING CO, LTD.), 40 parts of carbon black (Regal 400R, available from Cabot Corp.), 60 parts of the unreactive resin [A] and 30 parts of water were added, the components were mixed, and then the mixture was kneaded at 150° C. for 30 minutes using two rollers, extrusion cooled and crushed with the use of a pulverizer to obtain a masterbatch. This was taken as masterbatch 1.

<Synthesis of Masterbatch 2>

In HENSCHEL MIXER (available from MITSUI MINING CO., LTD.), 40 parts of a magenta pigment (C.I.P.R. 184), 60 parts of the unreactive resin [A] and 30 parts of water were added, the components were mixed, and the mixture was kneaded at 150° C. for 30 minutes using two rollers, extrusion cooled and crushed with the use of a pulverizer to obtain a masterbatch. This was taken as masterbatch 2.

Example 1

—Preparation of Toner 1—

<Preparation of Oil Phase>

Into a vessel equipped with a stirrer and a thermometer, 400 parts of the unreactive resin [A], 110 parts of carnauba wax, and 947 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 1, 110 parts of R972 (available from Nippon AEROSIL CO., LTD.), and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO, LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 0.8.

<Emulsification>

The emulsification conditions were as follows.

Total amount of liquid feed: 10 kg/m

Hold-up amount: 20L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 30° C. for 2 hours.

<Solvent Removal, Washing, Production of Toner>

The solvent was removed as follows.

First, the temperature of the emulsion dispersion was raised to 45° C., and then the solvent was removed under the conditions of outer circumferential speed of the stirring blade of 10.5 m/s, atmosphere pressure of 101.3 kPa. It took 8 hours for removal of the solvent. Then, the emulsion dispersion was filtered. The filtered product was washed and dried to yield toner base particles.

Next, 100 parts of the obtained toner base particles and 0.3 parts of a charge controlling agent (BONTIRON E-84, available from Orient Chemical Industries, Ltd,) were poured in a Q mixer (MITSUI MINING CO., LTD.), the circumferential speed of the turbine blade was set to 50 m/s, and the Q mixer was run for 2 minutes and then stopped for 1 minute. The operation was repeatedly performed 5 times in 10 minutes in total.

Further, to HENSCHEL MIXER, 1.0 part of hydrophobic silica (H2000, available from Clariant Japan K. K.) was added. The circumferential speed of the blade was set to 15 m/s, and the mixer was run for 30 seconds and then stopped for 1 minute. The operation was repeatedly performed 5 times. Coarse particles were removed by passing the product through a sieve of 37 μm mesh to thereby obtain a toner.

Example 2

—Preparation of Toner 2—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 947 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 1, 22 parts of MEK-ST (available from NISSAN CHEMICAL INDUSTRIES, LTD.), and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 0.9.

Example 3

—Preparation of Toner 3—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 132 parts of carnauba wax, and 947 parts of ethyl acetate were poured, and the temperature of the mixture was raised to 80° C. with stirring and kept at 80° C. for 5 hours, is and the mixture was cooled to 30° C. in 1 hour. Next, in the reaction vessel, 500 parts of the masterbatch 1, 22 parts of MLE-ST (available from NISSAN CHEMICAL INDUSTRIES, LTD-), and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 1.5.

Example 4

—Preparation of Toner 4—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 132 parts of carnauba wax, and 947 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 1, 66 parts of MEK-ST (available from NISSAN CHEMICAL INDUSTRIES, LTD.), and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 5.3.

Example 5

—Preparation of Toner 5—

A toner was produced in the same manner as in Example 4 except that the process of "Emulsification" was changed as follows.

<Emulsification>

The emulsification conditions were as follows.

Total amount of liquid feed: 10 kg/m

Hold-up amount: 20 L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 23° C. for 2 hours.

Example 6

—Preparation of Toner 6—

A toner was produced in the same manner as in Example 4 except that the process of "Emulsification" was changed as follows <Emulsification>

The emulsification conditions were as follows

Total amount of liquid feed: 10 kg/m

Hold-up amount: 20 L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 43° C. for 2 hours.

Example 7

—Preparation of Toner 7—

A toner was produced in the same manner as in Example 4 except that the process of "Emulsification" was changed as follows.

<Emulsification>

The emulsification conditions were as follows.

Total amount of liquid feed: 10 kg/m

Hold-up amount: 20 L

Shearing rate of emulsifying apparatus: 17 m/s

Emulsification temperature: 15° C.

In the storage tank, the oil phase was stirred under the conditions of outer circumferential speed of the stirring blade of 10.6 m/s, atmosphere pressure of 101.3 kPa, and 30° C. for 2 hours.

Example 8

—Preparation of Toner 8—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 1, 66 parts of MEK-ST (available from NISSAN CHEMICAL INDUSTRIES, LTD.), and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO, LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,513 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 42%.

Here, the yield value of the oil phase was measured, and the Casson yield value of the oil phase was 1.0.

Example 9

—Preparation of Toner 9—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 2, and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zircolnia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 7.0.

Example 10

—Preparation of Toner 10—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 2, 110 parts of R972 (Nippon AEROSIL CO., LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available 5 from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 10.1.

Example 11

—Preparation of Toner 11—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 1,058 parts of ethyl acetate were poured, and the temperature of the mixture was raised to 80° C. with stirring and kept at 80° C. for 5 hours, and the mixture was cooled to 30° C. in 1 hour Next, in the reaction vessel, 500 parts of the masterbatch 2, 22 parts of MEK-ST (NISSAN CHEMICAL INDUSTRIES, LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 10.1.

Example 12

—Preparation of Toner 12—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax, and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 2, 22 parts of MEK-ST (NISSAN CHEMICAL INDUSTRIES, LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,103 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 58%.

Here, the yield value of the oil phase was measured, and the Casson yield value of the oil phase was 19.2.

Example 13

—Preparation of Toner 13—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of paraffin wax (HNP-9, available from NIPPON SEIRO CO.,LTD), and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 2, 22 parts of MEK-ST (NISSAN CHEMICAL INDUSTRIES, LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,103 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 58%.

Here, the yield value of the oil phase was measured, and the Casson yield value of the oil phase was 15.4

Comparative Example 1

—Preparation of Toner 14—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax and 947 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 1 and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMLEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 0.1.

Comparative Example 2

—Preparation of Toner 15—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax and 947 parts of ethyl acetate were poured, and the temperature of the mixture was raised to 80° C. with stirring and kept at 80° C. for 5 hours and the mixture was cooled to 30° C. in 1 hour. Next, in the reaction vessel, 500 parts of the masterbatch 1, 66 parts of R972 (Nippon AEROSIL CO., LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 0.3.

Comparative Example 3

—Preparation of Toner 16—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax and 947 parts of ethyl acetate were poured, and the temperature of the mixture was raised to 80° C. with stirring and kept at 80° C. for 5 hours, and the mixture was cooled to 30° C, in 1 hour. Next, in the reaction vessel, 500 parts of the masterbatch 1, 66 parts of R972 (Nippon AEROSIL CO., LTD.) and 500 parts of ethyl acetate were poured, and the components were mixed for 1 hour to thereby obtain raw material solution 1.

Next, 1,224 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 65% ethyl acetate solution of the unreactive resin [A] were added. The components were is dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 0.3.

<Emulsification>

The emulsification conditions were as follows.

Total amount of liquid feed: 10 kg/m

Hold-up amount: 20 L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 43° C. for 2 hours.

As the result, coarsening of particles occurred during the stirring, although there was no problem with emulsification, and it was impossible to measure the particle diameter. However, for the purpose of measuring the glass transition temperature (Tg) of the toner, the organic solvent was washed in the same manner as in Example 1.

Comparative Example 4

—Preparation of Toner 17—

<Preparation of Oil Phase>

An oil phase of Comparative Example 4 was prepared in the same manner as in Example 4.

<Emulsification>

The emulsification conditions were as follows.

Total amount of liquid feed: 10 kg/m

Hold-up amount: 20 L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 20° C. for 2 hours.

<Solvent Removal, Washing, Production of Toner>

The solvent was removed as follows

First, the temperature of the emulsion dispersion was raised to 45° C., and then the solvent was removed under the conditions of outer circumferential speed of the stirring blade of 10.5 m/s, and atmosphere pressure of 101.3 kPa. It took 8 hours for removal of the solvent. Then, the emulsion dispersion was filtered. The filtered product was washed and dried to yield toner base particles.

Next, 100 parts of the obtained toner base particles and 0.3 parts of a charge controlling agent (BONTRON E-84, available from Orient Chemical Industries, Ltd.) were poured in a Q mixer (MITSUI MINING CO., LTD.), the circumferential speed of the turbine blade was set to 50 m/s, and the Q mixer was run for 2 minutes and then stopped for I minute. The operation was repeatedly performed 5 times in 10 minutes in total.

Further, to HENSCHEL MIXER, 1.0 part of hydrophobic silica (H2000, available from Clariant Japan K. K.) was added. The circumferential speed of the blade was set to 15 m/s, and the mixer was run for 30 seconds and then stopped for 1 minute. The operation was repeatedly performed 5 times. Coarse particles were removed by passing the product through a sieve of 37 μm mesh to thereby obtain a toner.

Comparative Example 5

—Preparation of Toner 18—

<Preparation of Oil Phase>

An oil phase of Comparative Example 5 was prepared in the same manner as in Example 4.

<Emulsification>

The emulsification conditions were as follows.

Total amount of liquid feed; 10 kg/m

Hold-up amount: 20 L

Shearing rate of emulsifying apparatus: 17 m/s

Emulsification temperature: 30° C.

In the storage tank, the oil phase was stirred under the conditions of outer circumferential speed of the stirring blade of 10.5 m/s, atmosphere pressure of 101.3 kPa, and 30° C. for 2 hours.

<Solvent Removal, Washing, Production of Toner>

The solvent was removed as follows.

First, the temperature of the emulsion dispersion was raised to 45° C., and then the solvent was removed under the conditions of outer circumferential speed of the stirring blade of 10.5 m/s, atmosphere pressure of 101.3 kPa. It took 8 hours for removal of the solvent Then, the emulsion dispersion was filtered. The filtered product was washed and dried to yield toner base particles.

Next, 100 parts of the obtained toner base particles and 0.3 parts of a charge controlling agent (BONTRON E-84, available from Orient Chemical Industries, Ltd.) were poured in a Q mixer (MITSUI MINING CO., LTD.), the circumferential speed of the turbine blade was set to 60 m/s, and the Q mixer was run for 2 minutes and then stopped for 1 minute. The operation was repeatedly performed 5 times in 10 minutes in total.

Further, to HENSCHEL MIXER, 1.0 part of hydrophobic silica (H2000, available from Clariant Japan K. K.) was added. The circumferential speed of the blade was set to 15 m/s, and the mixer was run for 30 seconds and then stopped for 1 minute. The operation was repeatedly performed 5 times. Coarse particles were removed by passing the product through a sieve of 37 μm mesh to thereby obtain a toner.

Comparative Example 6

—Preparation of Toner 19—

<Preparation of Oil Phase>

An oil phase of Comparative Example 5 was prepared in the same manner as in Example 4.

<Emulsification>

The emulsification conditions were as follows.

Total amount of liquid feed: 10 kg/m

Hold-up amount: 20 L

Shearing rate of emulsifying apparatus: 17 m/s

Emulsification temperature: 20° C.

In the storage tank, the oil phase was stirred under the conditions of outer circumferential speed of the stirring blade of 10.5 m/s, atmosphere pressure of 101.3 kPa, and 50° C. for 2 hours.

As the result, coarsening of particles occurred during the stirring, although there was no problem with emulsification, and it was impossible to measure the particle diameter. However, for the purpose of measuring the glass transition temperature (Tg) of the toner, the organic solvent was washed in the same manner as in Example 1.

Comparative Example 7

—Preparation of Toner 20—

A toner was produced in the same manner as in Example 1 except that the process of "Preparation of Oil Phase" was changed as follows.

<Preparation of Oil Phase>

Into a vessel equipped with a stirrer and a thermometer, 400 parts of the unreactive resin [A], 110 parts of carnauba wax and 1,058 parts of ethyl acetate were poured, and the temperature of the mixture was raised to 80° C. with stirring and kept at 80° C. for 5 hours, and the mixture was cooled to 30° C. in 1 hour. Next, in the reaction vessel, 500 parts of the masterbatch 2, 66 parts of MEK-ST (NISSAN CHEMICAL INDUSTRIES, LTD.) and 500 parts of ethyl acetate were poured, and the components were mixed for 1 hour to thereby obtain raw material solution 1.

Next, 1,324 parts of the raw material solution 1 were poured into the reaction vessel, and the components were subjected to a dispersion treatment using a bead mill (Ultra Visco Mill, available from AIMEX CO., LTD.) under the conditions of a liquid feed rate of 1 kg/hr, disc circumferential speed of 6 m/s, and filled with 0.5 mm zirconia beads at 80% by volume, and the dispersion treatment was repeated 3 times to thereby disperse the wax in the components. Next, to the reaction vessel, 1,324 parts of 66% ethyl acetate solution of the unreactive resin [A] were added. The components were dispersed once in the bead mill under the same conditions stated above to thereby obtain pigment-wax dispersion 1. The solid concentration of the pigment-wax dispersion measured at 130° C. for 30 minutes was 50%.

Here, the yield value of the oil phase was measured, and the Casson yield value of the oil phase was 25.0.

Next, each of the toners prepared in the Examples and Comparative Examples were evaluated as follows. Evaluation items are described below. Table 1 shows the evaluation results.

<Measurement of Volume Average Particle Diameter (Dv) and Volume Average Particle Diameter/Number Average Particle Diameter (Dv/Dn)>

With respect to each of the prepared toners, the volume average particle diameter, and the volume average particle diameter/number average particle diameter (Dv/Dn) were measured using a measurement apparatus for particle size distribution based on Coulter Counter technique, specifically, using Coulter Counter TA-II, available from Coulter Electronics Ltd.

First, 0.1 mL to 5 mL of a surfactant (alkylbenzenesulfonate) was added as a dispersant in 100 mL to 150 mL of an electrolytic aqueous solution. The electrolytic aqueous solution was 1% NaCl aqueous solution prepared using primary sodium chloride by means of ISOTON-II, available from Coulter Electronics Ltd. Here, 2 mg to 20 mg of a measurement sample was added to the electrolytic aqueous solution. The electrolytic aqueous solution with the sample suspended therein was dispersed in a ultrasonic dispersing unit for 1 minute to 3 minutes A 100 μm numerical aperture (NA) lens was used for the measurement apparatus. The volume of toner particles and the number of toner particles were measured by means of the measurement apparatus, and then the volume distribution and the number distribution of toner particles were calculated based on the measured volume and number of particles. From the obtained distributions, the volume average particle diameter (Dv) and the number average particle diameter (Dn) were determined.

Toner particles having a diameter of 2.00 μm less than 40.30 μm were intended for the evaluation. The following 13 channels were used. A channel of 2.00 μm to less than 2.52 μm; a channel of 2.52 μm to less than 3.17 μm; a channel of 3.17 μm to less than 4.00 μm; a channel of 4.00 μm less to less than 5.04 μm to less than; a channel of 5.04 μm to less than 6.35 μm; a channel of 6.35 μm to less than 8.00 μm; a channel of 8.00 μm to less than 10.08 μm; a channel of 10.08 μm to less than 12.70 μm; a channel to 12.70 μm to less than 16.00 μm; 16.00 μm to less than 20.20 μm; 20.20 μm to less than 26.40 μm: 25.40 μm to less than 32.00 μm; 32.00 μm to less than 40.30 μm.

<Measurement of Average Circularity>

The average circularity of the obtained each toner was measured by using a flow particle image analyzer FPIA-2100 (available from SYSMEX Corp.) and analysis software (FPIA-2100 Data Processing Program for FPIA version 00-10).

Specifically, in a 100 mL glass beaker, 0.1 mL to 0.5 mL of a 10% by mass surfactant (alkylbenzenesulfonate, Neogen SC-A, available from Daiichi Kogyo Seiyaku Co., Ltd.) was added, and further 0.1 g to 0.5 g of the each toner was added, and the components were stirred using Micro Spacer. Next, 80 mL of ion exchange water was added thereto. The components were dispersed for 1 minute under the conditions of 20 kHz and 50W/10 $cm^3$ using a ultrasonic dispersing unit, UH-50 (available from STM Co.). The components were further dispersed for 5 minutes in total. The sample dispersion having a concentration of the measured sample dispersion particles of 4,000 pieces/$10^{-3}$ $cm^3$ to 8,000 pieces/$10^{-3}$ $cm^3$ were used to measure the particle size distribution and the shape of particles having a diameter equivalent to a circle diameter of 0.60 μm to less than 159.21 μm.

The sample dispersion was passed through a flow channel widening along with the flowing direction of a transparent flat flow cell having a thickness of around 200 μm. To form an optical path passing through the flow cell intersecting with the thickness of the flow cell, a strobe light and a CCD camera were attached to the flow cell such that the strobe light and the CCD camera were positioned so as to sandwich the flow cell and face to each other. During flowing of the sample dispersion in the flow cell, the sample dispersion was irradiated with the strobe light at intervals of 1/30 seconds to obtain an image of particles flowing in the flow cell. As the result, an image of individual particles was taken as a two-dimensional image having a certain area in parallel with the flow cell. From the areas of the individual particles in the two-dimensional image, the diameter of a circle having the same area as those of the individual particles was calculated as a diameter equivalent to the circle diameter. In about one minute, the diameter equivalent to the circle diameter of 1,200 or more particles could be measured, and the number of particles based on the circle diameter distribution and the rate (% by number) of particles having a defined circle diameter can be measured. The results of the frequency percent and the cumulative percent can be indicated, as shown in Table 1, by dividing the range of 0.06 μm to 400 μm into 226 channels (dividing one octave into 30 channels). In the actual measurement, toner particles having a diameter equivalent to a circle diameter ranging from 0.60 μm to 159.21 μm were measured, and the rate of the number of particles having a diameter 20 equivalent to a circle diameter ranging from 0.6 μm to 2.0 μm was calculated —Judgment—

Table 1 shows the judgment results obtained from the measurement results.

Each of the obtained toners was judged as follows. With respect to cleaning ability of toner, a toner having an average circularity of 0.970 or more was judged as C, a toner having an average circularity of 0.966 to 0.970 was judged as B, and a toner having an average circularity of 0.946 to 0.965 was judged as A, a toner having an average circularity of 0.940 to 0.945 was judged as B. With respect to transferring property and image quality of toner, and a toner having an average circularity of 0.940 or less was judged as C.

<Measurement of Glass Transition Temperature (Tg)>

As to the obtained each toner, the glass transition temperature (Tg) was measured as follows. As a measurement apparatus for glass transition temperature (Tg), TG-DSC system TAS-100 available from Rigaku Corporation was used.

First, 10 mg of a sample was put in an aluminum sample container, and the container was attached to a holder unit so as to be set in an electric furnace. The sample was heated from room temperature to 150° C. at a rate of temperature increase of 10°/m, left at 150° C. for 10 minutes, and the sample was cooled to room temperature, left as it was for 10 minutes and then heated again in a nitrogen atmosphere to 150° C. to perform DSC measurement. The glass transition temperature (Tg) was calculated from the contact point between the tangent with the endothermic curve near the glass transition temperature (Tg) and the base line.

<Transferring Property>

The obtained each toner was evaluated as to transferring property as follows.

(1) The toner and all the apparatuses to be used in the evaluation were left in a room in which the temperature was set at 25° C. and the humidity was set at 50% for one day.

(2) The entire amount of toner stocked in a commercial product PCU of imagio neo C600 was removed, and only a carrier in the developing apparatus was left as it was.

(3) In the developing apparatus housing only the carrier, 28 g of a toner sample was introduced to prepare 400 g of a developer having a toner concentration of 7%.

(4) The developer was put in the PCU, the machine was operated, and then a 100% solid image was output.

(5) The toner image was transferred onto paper sheet TYPE6200 manufactured by Ricoh Company Ltd. Immediately after the transferring, the machine was stopped, and then the image density (ID) of the transferred image carried on the photoconductor was measured. Here, an image having an image density of 0.03 or less was evaluated as A in terms of transferring property, an image having an image density of 0.03 or more was evaluated as B, and an image having an image density of 0.05 or more was evaluated as C.

<Evaluation of Cleaningability>

(1) The toner and all the apparatuses to be used in the evaluation were left in a room in which the temperature was set at 25° C. and the humidity was set at 50% for one day, PCU of imagio Neo C600 was used; the elastic modulus was set at 70%, the thickness of 2 mm, and the angle of the counter in contact with the image bearing member was set at 20° C.

(7) In the developing conditions, the transfer current was adjusted such that the transferring rate was 96%±2%.

(8) A fibrous tape was strained and set in front of the charge roller so as to trap a toner after being subjected to a cleaning treatment or a toner slipping through the cleaning blade.

(9) 1,000 paper sheets of a chart having a band image print of 4 cm in the sheet-transporting direction and 25 cm in the sheet-transporting width direction were output using the above-mentioned setting values.

(10) The weight of a tone attached to the tape set in (8) was is measured to evaluate the amount of toner slipping through the cleaning blade. When the amount of toner slipping through the cleaning blade was less than 0.15 g, the toner was evaluated as A. When the amount of toner slipping through the cleaning blade was less than 0.25 g, the toner was evaluated as B. When the amount of toner slipping through the cleaning blade was more than 0.25 g or more, the toner was evaluated as C.

TABLE 1

| | Toner No. | Glass transition temperature (Tg) (° C.) | Average circularity | Volume average particle diameter (Dv) (μm) | Dv/Dn | Cleaning-ability | Transferring property | Judgment |
|---|---|---|---|---|---|---|---|---|
| Ex. 1 | Toner 1 | 45.1 | 0.968 | 5.3 | 1.20 | B | A | B |
| Ex. 2 | Toner 2 | 45.3 | 0.965 | 5.4 | 1.15 | A | A | A |
| Ex. 3 | Toner 3 | 44.8 | 0.958 | 5.2 | 1.15 | A | A | A |
| Ex. 4 | Toner 4 | 45.3 | 0.953 | 5.1 | 1.15 | A | A | A |
| Ex. 5 | Toner 5 | 45.1 | 0.968 | 5.6 | 1.15 | A | A | B |
| Ex. 6 | Toner 6 | 44.9 | 0.943 | 6.2 | 1.30 | A | B | B |
| Ex. 7 | Toner 7 | 45.1 | 0.949 | 5.1 | 1.15 | A | A | A |
| Ex. 8 | Toner 8 | 45.2 | 0.967 | 5.1 | 1.13 | B | A | B |
| Ex. 9 | Toner 9 | 44.8 | 0.952 | 5.1 | 1.25 | A | B | B |
| Ex. 10 | Toner 10 | 45.1 | 0.952 | 5.3 | 1.20 | A | B | A |
| Ex. 11 | Toner 11 | 45.2 | 0.948 | 5.0 | 1.20 | A | A | A |
| Ex. 12 | Toner 12 | 45.3 | 0.941 | 5.9 | 1.19 | A | B | B |
| Ex. 13 | Toner 13 | 45.1 | 0.956 | 5.1 | 1.15 | A | A | A |
| Compara. Ex. 1 | Toner 14 | 44.8 | 0.980 | 5.0 | 1.25 | C | A | C |
| Compara. Ex. 2 | Toner 15 | 44.9 | 0.975 | 5.5 | 1.20 | C | A | C |
| Compara. Ex. 3 | Toner 16 | 45.0 | — | Coarsely formed | — | — | — | C |
| Compara. Ex. 4 | Toner 17 | 44.8 | 0.974 | 5.1 | 1.15 | C | A | C |
| Compara. Ex. 5 | Toner 18 | 45.2 | 0.975 | 5.6 | 1.25 | C | A | C |
| Compara. Ex. 6 | Toner 19 | 45.3 | — | Coarsely formed | — | — | — | C |
| Compara. Ex. 7 | Toner 20 | 45.2 | 0.930 | 5.2 | 1.23 | A | C | C |

In Table 1, the symbol "—" represents that it was impossible to measure the property.

(2) The entire amount of toner stocked in a commercial product PCU of imagio Neo C600 was removed, and only a carrier in the developing apparatus was left as it was.

(3) In the developing apparatus housing only the carrier, 28 g of a toner sample was introduced to prepare 400 g of a developer having a toner concentration of 7%.

(4) A developing apparatus was attached to the body of imagio Neo C600, and only the developing apparatus was made to go round for 5 minutes at a developing sleeve linear velocity of 300 mm/s.

(5) Both of the developing sleeve and the photoconductor were rotated at a trailing speed of 300 mm/s to thereby adjust the charge potential and the developing bias such that a toner carried on the photoconductor was 0.6 mg/cm$^2$±0.05 mg/cm$^2$.

(6) For a cleaning blade used in the machine, only one cleaning blade which was installed in a commercial product In Table 1, the symbol "-" means that it was impossible to measure the value.

As can be seen from the results shown in Table 1, the toners of Examples 1 to 13 were evaluated as B or A as the total judgment in view of the glass transition temperature (Tg), average circularity, volume average particle diameter (Dv), and dispersivity of toner and were judged as a toner having no problem in practical use. However, the toners of Comparative Examples 1 to 7 were evaluated as C as the total judgment and judged as a toner that could not be used in practical use.

What is claimed is:

1. A method for producing a toner comprising:

preparing an emulsified dispersion which comprises emulsion particles by emulsifying or dispersing an oil phase containing at least a pigment and any one of a binder resin and a binder resin precursor in an aqueous medium, and granulating toner base particles by converging the emulsified dispersion, wherein the Casson yield value of the oil phase in an isolated condition before being emulsified or dispersed in the aqueous medium is 0.5 Pa to 20 Pa; and the temperature Tn of the emulsified dispersion in the preparation of the emulsified dispersion, the temperature Ts of the emulsified dispersion in the granulation of the toner base particles, and the glass transition temperature Tg of the toner base particles satisfy the relation $Tn<Ts<Tg$.

2. The method for producing a toner according to claim 1, further comprising dehydrating and drying the toner base particles.

3. The method for producing a toner according to claim 1, wherein the oil phase further comprises inorganic fine particles.

4. The method for producing a toner according to claim 1, wherein the temperature Tn of the emulsified dispersion in the preparation of the emulsified dispersion, the temperature Ts of the emulsified dispersion in the granulation of the toner base particles, and the glass transition temperature Tg of the toner base particles satisfy the relation $Tn+5°\ C.<Ts<Tg-5°\ C.$

5. The method for producing a toner according to claim 1, wherein the toner base particles have a glass transition temperature Tg of 40° C. to 55° C.

6. The method for producing a toner according to claim 1, wherein the toner base particles have an average circularity of 0.930 to 0.970.

7. The method for producing a toner according to claim 3, wherein the inorganic oxide fine particles are organosol particles.

8. The method for producing a toner according to claim 1, wherein the oil phase has a solid concentration (resin/(resin solvent)) of 40% by mass to 60% by mass.

9. The method for producing a toner according to claim 1, wherein the oil phase comprises an active hydrogen group-containing compound and a resin having a functional group capable of reacting with the active hydrogen group-containing compound.

10. The method for producing a toner according to claim 1, wherein the emulsified dispersion is prepared by using a continuous emulsifying apparatus.

11. The method for producing a toner according to claim 1, wherein the toner base particles are granulated in a storage tank.

12. The method for producing a toner according to claim 1, wherein the Casson yield value is 5 Pa·s to 15.0 Pa·s.

* * * * *